US009751226B2

(12) United States Patent
Psimadas et al.

(10) Patent No.: US 9,751,226 B2
(45) Date of Patent: Sep. 5, 2017

(54) PROTECTIVE COVER FOR A SHAVING CARTRIDGE, A SHAVING ASSEMBLY, A RAZOR, A METHOD OF SHAVING WITH SUCH A RAZOR AND A METHOD OF MANUFACTURING A PROTECTIVE COVER

(75) Inventors: Yiannis Marios Psimadas, Vrillissia-Athens (GR); Ioannis Bozikis, Koukaki-Athens (GR); Luca Iaccarino, Paleo Faliro (GR)

(73) Assignee: BIC VIOLEX S.A., Anixi (GR)

( * ) Notice: Subject to any disclaimer, the term of this patent is extended or adjusted under 35 U.S.C. 154(b) by 279 days.

(21) Appl. No.: 13/818,197

(22) PCT Filed: Aug. 4, 2011

(86) PCT No.: PCT/EP2011/063497
§ 371 (c)(1),
(2), (4) Date: Apr. 30, 2013

(87) PCT Pub. No.: WO2012/028413
PCT Pub. Date: Mar. 8, 2012

(65) Prior Publication Data

US 2013/0199346 A1 Aug. 8, 2013

(30) Foreign Application Priority Data

Aug. 30, 2010 (EP) ..... 2010/062632

(51) Int. Cl.
*B26B 21/42* (2006.01)
*B26B 21/40* (2006.01)
(Continued)

(52) U.S. Cl.
CPC ..... *B26B 21/4037* (2013.01); *B26B 21/225* (2013.01); *B26B 21/4006* (2013.01);
(Continued)

(58) Field of Classification Search
CPC ..... B26B 21/24; B26B 21/40; B26B 21/38; B26B 21/36; B26B 21/4037;
(Continued)

(56) References Cited

U.S. PATENT DOCUMENTS 1,911,378 A * 5/1933 Martin ..... 30/50
2,171,880 A * 9/1939 Lewis ..... 30/31
(Continued)

FOREIGN PATENT DOCUMENTS

GB 2 207 074 A 1/1989
WO WO 97/06711 2/1997
(Continued)

OTHER PUBLICATIONS

International Search Report for PCT/EP2011/063497.

*Primary Examiner* — Ghassem Alie
*Assistant Examiner* — Nhat Chieu Do
(74) *Attorney, Agent, or Firm* — Polsinelli PC

(57) ABSTRACT

A protective cover for a shaving cartridge, a shaving assembly including a cartridge and a protective cover, a razor having a razor handle and such a shaving assembly, a method of shaving with such a razor and a method of manufacturing such a protective cover. The protective cover includes a housing extending longitudinally along a longitudinal axis (A) and is provided with a comb and a trimming blade, the trimming blade having an elongated cutting edge and the comb having several teeth projecting obliquely to the longitudinal axis (A) and protruding forwardly with regard to the trimming blade.

13 Claims, 20 Drawing Sheets

(51) Int. Cl.
*B26B 21/22* (2006.01)
*B26B 21/52* (2006.01)

(52) U.S. Cl.
CPC ..... *B26B 21/4043* (2013.01); *B26B 21/4068* (2013.01); *B26B 21/4081* (2013.01); *B26B 21/42* (2013.01); *B26B 21/521* (2013.01); *Y10T 29/49956* (2015.01); *Y10T 83/04* (2015.04)

(58) Field of Classification Search
CPC ..... B26B 21/225; B26B 21/4006; B26B 21/4043; B26B 21/521; B26B 21/4068; B26B 21/4081; B26B 21/42; Y10T 83/04; Y10T 29/49956
USPC ..... 30/32, 50, 34.2, 34.1, 77
See application file for complete search history.

(56) References Cited

U.S. PATENT DOCUMENTS 3,183,589 A * 5/1965 Szabo ..... B26B 21/08 30/30
3,219,180 A * 11/1965 Rosen ..... B65D 83/10 206/358
3,699,653 A * 10/1972 Miller ..... B26B 21/08 30/30
4,510,688 A * 4/1985 White ..... A41H 31/005 30/294
5,386,750 A 2/1995 Morrison
7,188,422 B2 * 3/2007 McCambridge ..... B26B 19/06 30/122
2010/0011586 A1 1/2010 Nicoll et al.
2010/0071214 A1 3/2010 Kinghorn
2011/0308087 A1 * 12/2011 Rehbein ..... B26B 19/06 30/34.1

FOREIGN PATENT DOCUMENTS

WO WO 2010/009181 A2 1/2010
WO WO 2012/028171 A1 3/2012

* cited by examiner

FIG. 2E
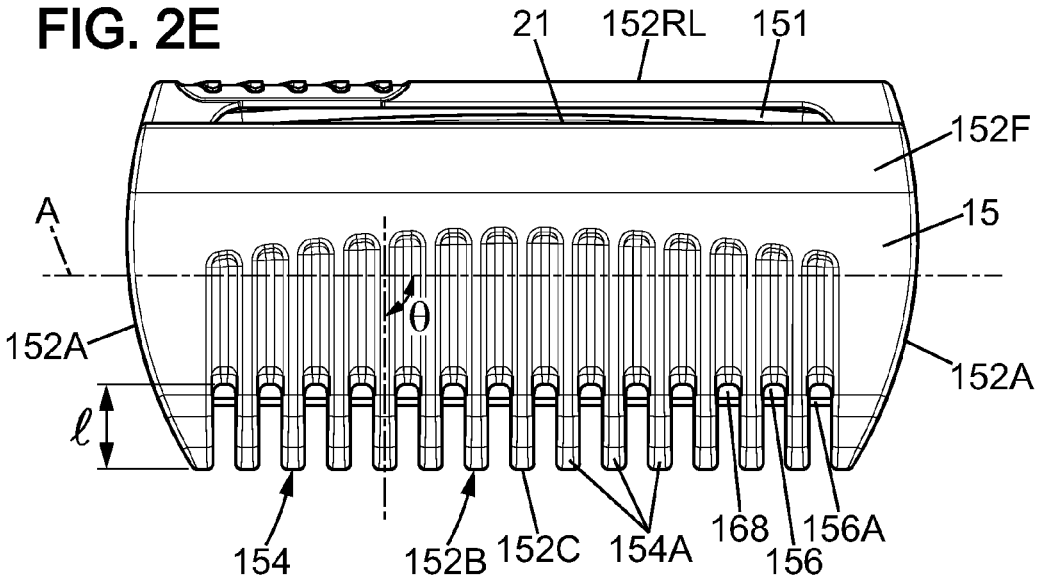
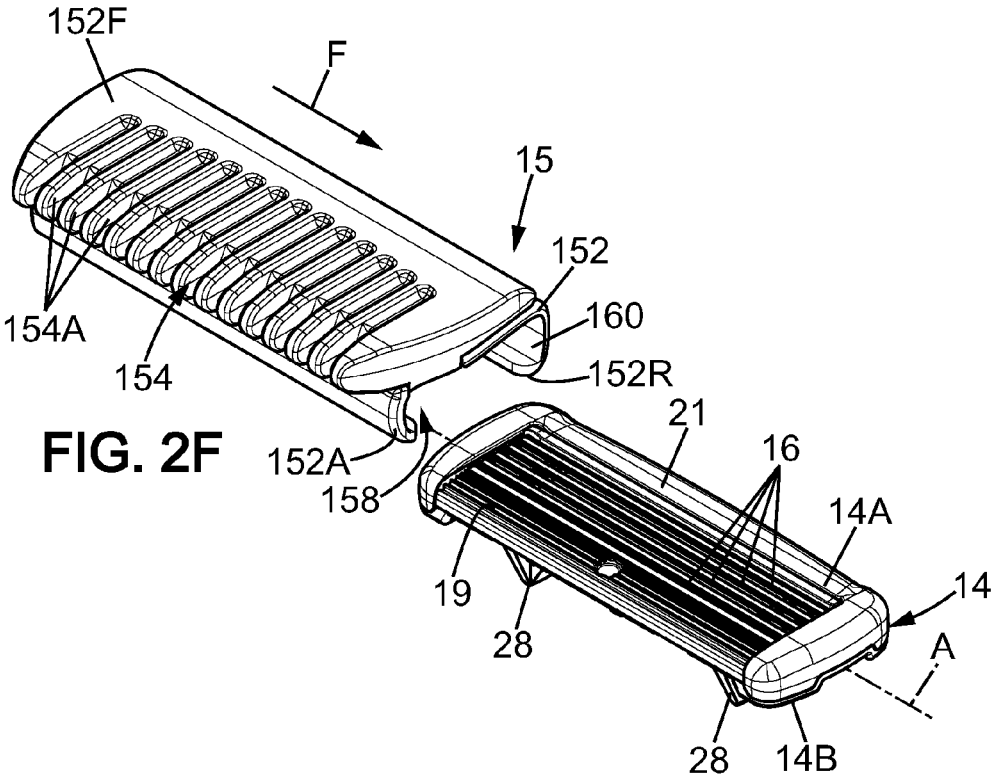
FIG. 2F

PROTECTIVE COVER FOR A SHAVING CARTRIDGE, A SHAVING ASSEMBLY, A RAZOR, A METHOD OF SHAVING WITH SUCH A RAZOR AND A METHOD OF MANUFACTURING A PROTECTIVE COVER

CROSS REFERENCE TO RELATED APPLICATION

This application is a national stage application of International Application No. PCT/EP2011/063497, filed on Aug. 4, 2011, which claims the benefit of European Patent Application No. 2010/062632 filed on Aug. 30, 2010, the entire contents of both applications being incorporated herein by reference.

FIELD OF THE INVENTION

The embodiments of the present invention relate to a protective cover for a shaving cartridge, to shaving assemblies that includes a cartridge and a protective cover, to a razor that has a razor handle and such an assembly and to methods of shaving.

BACKGROUND OF THE INVENTION

In particular, the embodiments of the present invention are related to the manner to protect a shaving cartridge and to shave the hair to a given length.

Generally, the covers are provided on the shaving cartridge to protect the cartridge from dust, cutting, etc.

However, such known covers are limited to that protective function and are released from the shaving cartridge before shaving.

Besides, covers also exist which are provided with a comb allowing the shaving to a given length, since such combs give access to the shaving blades provided on the shaving cartridge.

However, such covers provided with a comb lost their protective function since the shaving blades provided on the shaving cartridge are at least partially accessible through the teeth of the comb.

Therefore, the known covers do not allow both protecting the shaving blades and allowing shaving to a given length.

SUMMARY OF THE EMBODIMENTS OF THE PRESENT INVENTION

To this aim, it is provided a cover and a method which allow both protecting the shaving blades and trimming hair to a given length with a sole cover.

To this end, according to the embodiments of the present invention, the protective cover includes a housing extending longitudinally along a longitudinal axis and is provided with a comb and a trimming blade, the trimming blade having an elongated cutting edge and the comb having several teeth projecting obliquely to the longitudinal axis and protruding forwardly with regard to the trimming blade. The elongated cutting edge of the trimming blade can be parallel to the longitudinal axis or can be tilted with regard to the longitudinal axis.

The cover of the embodiments of the present invention thus allow protecting the shaving blades of the shaving cartridge and shave hair to a given length.

In various embodiments of the present invention, one and/or the other of the following features may be incorporated in this cover alone or in mutual combination:

the teeth are perpendicular to the longitudinal axis and preferably protrude forwardly with regard to the housing;

the cover is provided with a rear opening through which the connecting members of a shaving cartridge covered by the cover are accessible for the connection to a razor handle;

the housing includes a front face and a rear face, the trimming blade and the comb being provided on the front face;

the housing includes a front face and a rear face, the trimming blade and the comb being provided on the front face, and the cover is provided with a rear opening provided on the rear face through which the connecting members of a shaving cartridge covered by the cover are accessible for connection to a razor handle;

the housing comprises a front face and a rear face, the housing includes an upper part and a lower part, the comb being provided on the upper part and the trimming blade is preferably located between the upper part and the lower part; a cavity is provided between the upper part and the lower part of the housing;

the protective cover is further provided with a forwardly skin contacting surface located forward the trimming blade and a rearwardly skin contacting surface located rearward of the trimming blade, the trimming blade being inclined with regard to a plane tangential to the rearwardly skin contacting surface;

the trimming blade is fixedly (meaning fixed and motionless) and unreleasably mounted in the housing; the trimming blade is preferably rivet mounted in the housing;

the trimming blade is movably mounted in the housing;

several trimming blades are provided on the housing;

the housing includes a back ventilation opening;

the comb is molded in two separate parts preferably corresponding to the teeth and to the rear part or in one single piece, the protective cover is further provided with several combs.

The embodiments of the present invention also concern a shaving assembly that includes a cartridge and a protective cover, the shaving cartridge preferably having one or more shaving blades each provided with a cutting edge, the protective cover being able to cover at least the cutting edge of the shaving blades.

In various embodiments of the present invention, one and/or the other of the following features may be incorporated in the shaving assembly alone or in mutual combination:

the protective cover preferably includes an opening through which the cover is slidable over the shaving cartridge to cover the shaving cartridge;

the protective cover covers the shaving cartridge the trimming blade, and more specifically its cutting edge, is parallel to or tilted with regard to the one or more shaving blades.

The embodiments of the present invention also concern a razor having a razor handle and a shaving assembly, the shaving cartridge being able to be attached to the razor handle.

In various embodiments of the present invention, one and/or the other of the following features may be incorporated in the razor alone or in mutual combination:

the razor handle extends through the rear opening when the protective cover is slid on the shaving cartridge and when the razor handle is attached to the shaving cartridge;

shaving cartridge is pivotally attached to the razor handle;

the razor handle extend longitudinally along a longitudinal direction, the longitudinal direction being perpendicular to the longitudinal axis of the protective cover;

the razor handle preferably includes a lock and release mechanism to attach a shaving cartridge on the razor handle or to release a shaving cartridge attached to the razor handle.

The embodiments of the present invention also concern a method of shaving wherein the user uses the above mentioned razor, selectively either in a first shaving manner in which the protective cover is removed from the shaving cartridge and the shaving cartridge is used for shaving, or in a second manner in which the protective cover is covering the shaving cartridge and the trimming blade of the cover is used for trimming body hair.

The embodiments of the present invention also concern a method of manufacturing a protective cover that includes a housing which includes an upper part and a lower part, which extends longitudinally along a longitudinal axis and which is provided with a comb and at least one trimming blade, the trimming blade having an elongated cutting edge which can be parallel to or tilted with regard to the longitudinal axis and the comb having several teeth protruding forwardly with regard to the trimming blade, the method comprising the steps of providing an upper part having a lower surface, including securing pins protruding from the lower surface, and a comb provided with several teeth, providing a trimming blade having trimming blade apertures in alignment with the securing pins, mounting the trimming blade onto an upper part, the securing pins passing through the trimming blade apertures, providing a lower part having securing apertures in alignment with the securing pins, mounting the lower part onto the trimming blade, the securing pins passing through the securing apertures, forming a crimping head at one end of each securing pin, thereby irremovably riveting both the trimming blade and the upper part onto the lower part.

This method can further include the steps of providing a spacer having holes in alignment with the securing pins, mounting the spacer onto the trimming blade, the securing pins passing through the holes, providing a second trimming blade having trimming blade apertures in alignment with the securing pins, mounting the second trimming blade onto the spacer, the securing pins passing through the trimming blade apertures, and forming a crimping head at one end of each securing pin, thereby riveting together the trimming blades, the spacer and the upper part onto the lower part.

This method can also further includes the steps of providing a securing pins member that includes the securing pins, fixedly attaching the securing pins member onto the lower surface of the upper part, and includes the step of molding the comb in a high polished surface mould cavity.

BRIEF DESCRIPTION OF THE DRAWINGS

Other characteristics and advantages of the embodiments of the present invention will readily appear from the following description of one embodiment, provided as non-limitative examples, in reference to the accompanying drawings.

In the drawings:

FIG. 2E is a top view of the protective cover shown in FIG. 2A, the protective cover covering the shaving cartridge.

FIG. 2F is a perspective view of the protective cover shown in FIG. 2A, the shaving cartridge being released.

On the different Figures, the same reference signs designate identical or similar elements.

DESCRIPTION OF PREFERRED EMBODIMENTS OF THE INVENTION

Figure 1A:
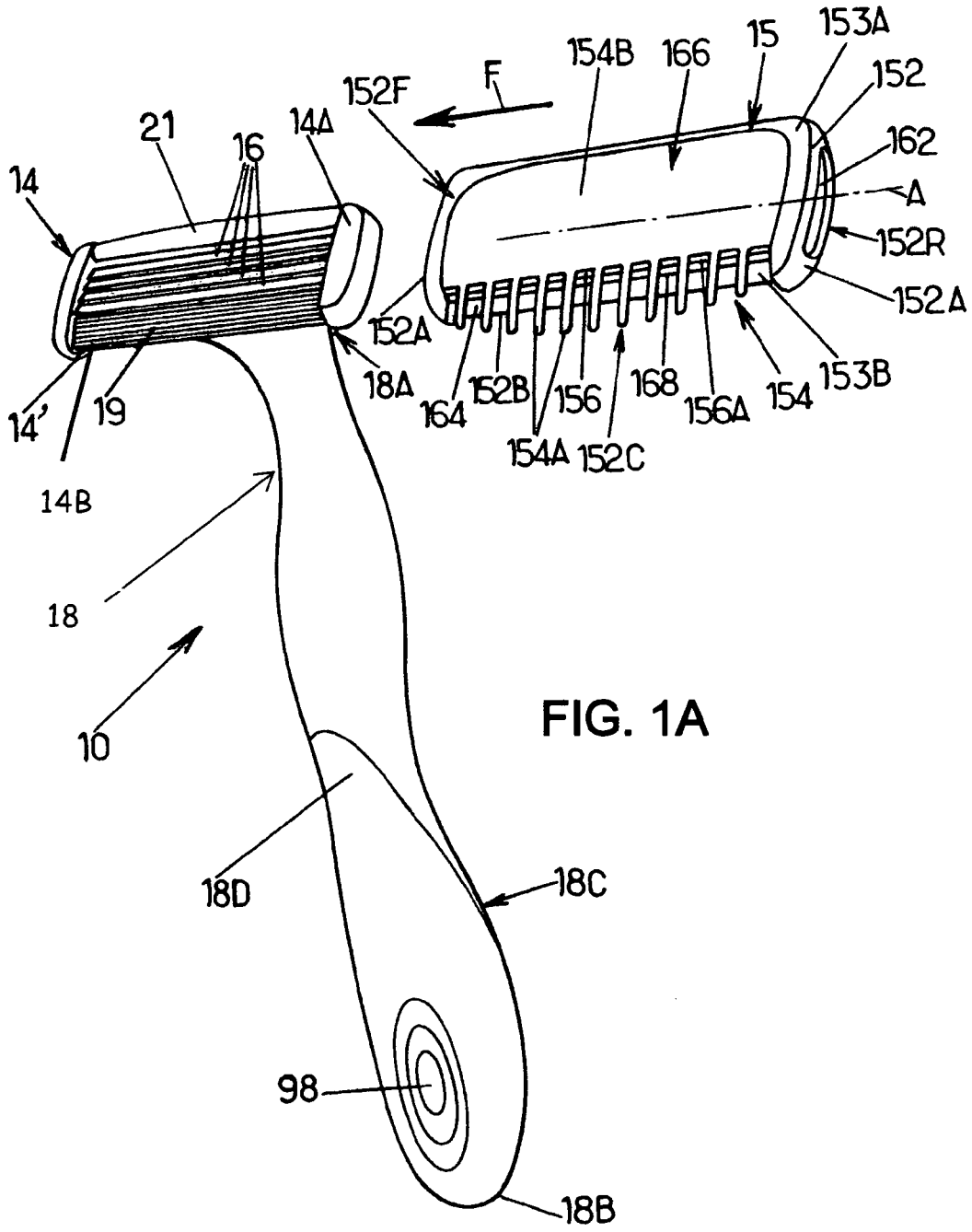
FIG. 1A is a perspective view of a razor according to the invention, the protective cover being released.
Figure 1B:
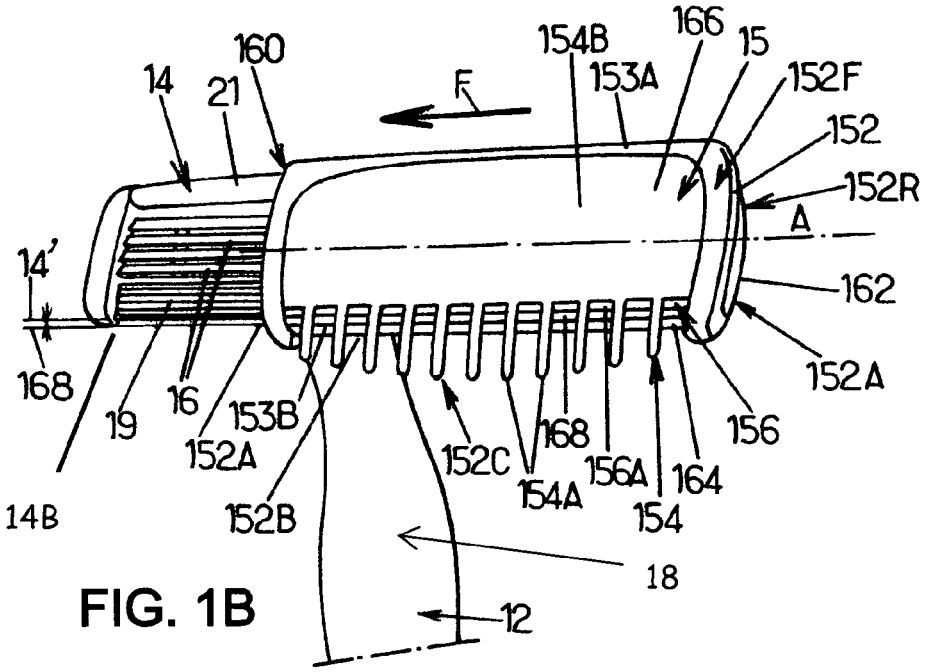
FIG. 1B is a perspective view of a razor according to an embodiment of the present invention, the cover being placed on the shaving cartridge to protect the cartridge.
Figure 1C:
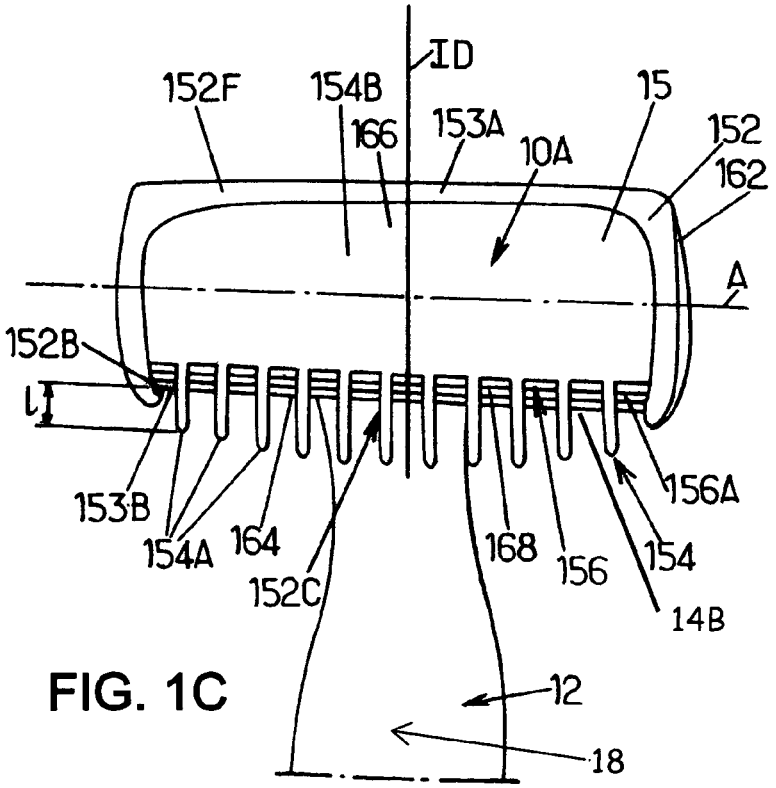
FIG. 1C is a perspective view of a razor according to an embodiment of the present invention, the protective cover covering the shaving cartridge.

FIG. 1A illustrates a wet razor 10 comprising a razor handle 12, a shaving cartridge 14 and a protective cover 15 which can cover the shaving cartridge 14 as illustrated on FIG. 1C and thus form a shaving assembly.

The shaving cartridge 14 is provided with one or more shaving blades 16 which can be movably or fixedly retained in the housing of the shaving cartridge 14. For instance, as illustrated on FIGS. 1A and 1B, the shaving cartridge 14 is provided with four shaving blades 16, but the embodiments of the present invention are not limited to the number of shaving blades.

As well known, the shaving cartridge 14 can further be provided with a guard bar 19 and/or with a lubra 21.

The shaving cartridge 14 is preferably a disposable shaving cartridge and includes a front face 14A having the one or several blades 16 exposed thereon, and a rear face 14B which can be connected to the razor handle 12 as illustrated on FIGS. 1A, 1B and 1C by connecting members 28.

As illustrated on the Figures, the razor handle 12 has an elongated handle body 18 extending in a longitudinal direction L between a front end 18A and a back end 18B. The longitudinal direction L may be curved and/or include one or several straight portions. The handle body 18 has an upper face 18C opposite to a lower face 18D.

The protective cover 15 can cover the shaving cartridge 14 in being releasably attached on the cartridge. Thus, the shaving cartridge 14 can be covered or uncovered with the protective cover 15. The protecting cover 15 can be slid on the shaving cartridge 14 as illustrated on FIGS. 1A and 1B by sliding it along arrow F. The protecting cover 15 can also be attached to the shaving cartridge 14 by any other way, like for instance by snap-fitting.

The protecting cover 15 includes a housing 152 extending longitudinally along a longitudinal axis A and is provided with a comb 154 and a trimming blade 156. The comb 154 and trimming blade 156, the protective cover 15 allows trimming hair at a given length. This is particularly useful when the razor according to the embodiments of the present invention is used to shave for instance the bikini area; of course, it can be used for other shaving and for instance also for cutting a beard to a given length.

That length can be adjustable. In that case, either the user can use another protecting cover 15 provided with a comb 154 having teeth of a height H154 different from the height of first protecting cover 15 in being all greater or all smaller, or the user can use a sole protecting cover 15 since the comb 154 is detachable from the housing 152. In that last case, the protecting cover 15 is able to receive interchangeable combs 154; one detachable comb 154 having teeth of a height different from the height of another detachable comb 154 in being all greater or all smaller. The height provided on any of the comb may also vary from one tooth to the other. The height H154 of the teeth can be comprised between 1 mm and 20 mm, preferably between 2 mm and 10 mm and/or preferably between 10 mm and 15 mm.

Besides, the number of teeth can be different from one protecting cover 15 to another one. For instance, the number of teeth can be comprised between 5 and 15, preferably equal to 7. According to the number or teeth provided on one comb in relation to its dimension, the density of teeth can be more or less important. The higher the density of teeth is (for instance 13 teeth for a comb of about 35 mm length), the easier the manufacture of the protecting covers 15 is, especially when manufacturing in series. More precisely, when manufactured in large quantities, the protecting covers 15 will be taken to another station where they will be attached to the shaving cartridge 14. The same appears previous the mounting of the trimming bladets) when the protecting covers 15 are to be provided on a separate mounting station where the trimming blade(s) will be mounted. Actually, each time there is a need to manipulate the protecting covers 15 there is risk of tangling the teeth of one comb with the teeth of another one. Thus, the density of teeth should be chosen in order to avoid the need of another manufacturing stage to detangle and align the combs. Besides, the tangled teeth between two or more combs could increase the scrap rate as tangled parts will lead to broken teeth.

Besides, the comb 154 can be non detachably fixed (meaning motionless) on the protecting cover 15 or it can be mounted movable on the protecting cover 15 in order to adjust the height H154 of the teeth to the desired height.

As depicted on FIGS. 1A-1C and 2C-2F, the trimming blade 156 is elongated along the longitudinal axis A and has an elongated cutting edge 156A parallel to the longitudinal axis A. The trimming blade 156 can be parallel to the longitudinal axis A or it can be inclined/tilted with regard to the longitudinal axis A as depicted on FIG. 3. More precisely, the trimming blade 156 can be tilted of an angle Ω with regard to the longitudinal axis A. This angle Ω is preferably comprised between 0° (the trimming blade edge 156A being parallel to the longitudinal axis A) and 60°, preferably between 0° and 45° or preferably between 0° and 20°.

The comb 154 has several teeth 154A which project obliquely to the longitudinal axis A and which protrude forwardly with regard to the trimming blade 156. More precisely, the angle θ between the teeth 154A and the longitudinal axis A can be of 90° as depicted on FIGS. 1A-1C and 2C-2F; the teeth 154A are perpendicular to the longitudinal axis A and the teeth protrude forwardly with regard to the housing 152. The angle θ between the teeth 154A and the longitudinal axis A can be different from 90° in being comprised between 20° and 160°. Besides, considering one comb, the angle θ can be the same for each of the teeth or may vary from one tooth to the other. According to the value of angle θ and the value of angle Ω, the teeth 154A can be perpendicular to the trimming blade(s) 156 or not. More precisely, the teeth 154A and the trimming blade edge(s) 156A can be respectively perpendicular to the longitudinal axis A and parallel to the longitudinal axis A or the teeth 154A and the trimming blade edge(s) 156A can be tilted with regard to the longitudinal axis A.

Figure 1D:
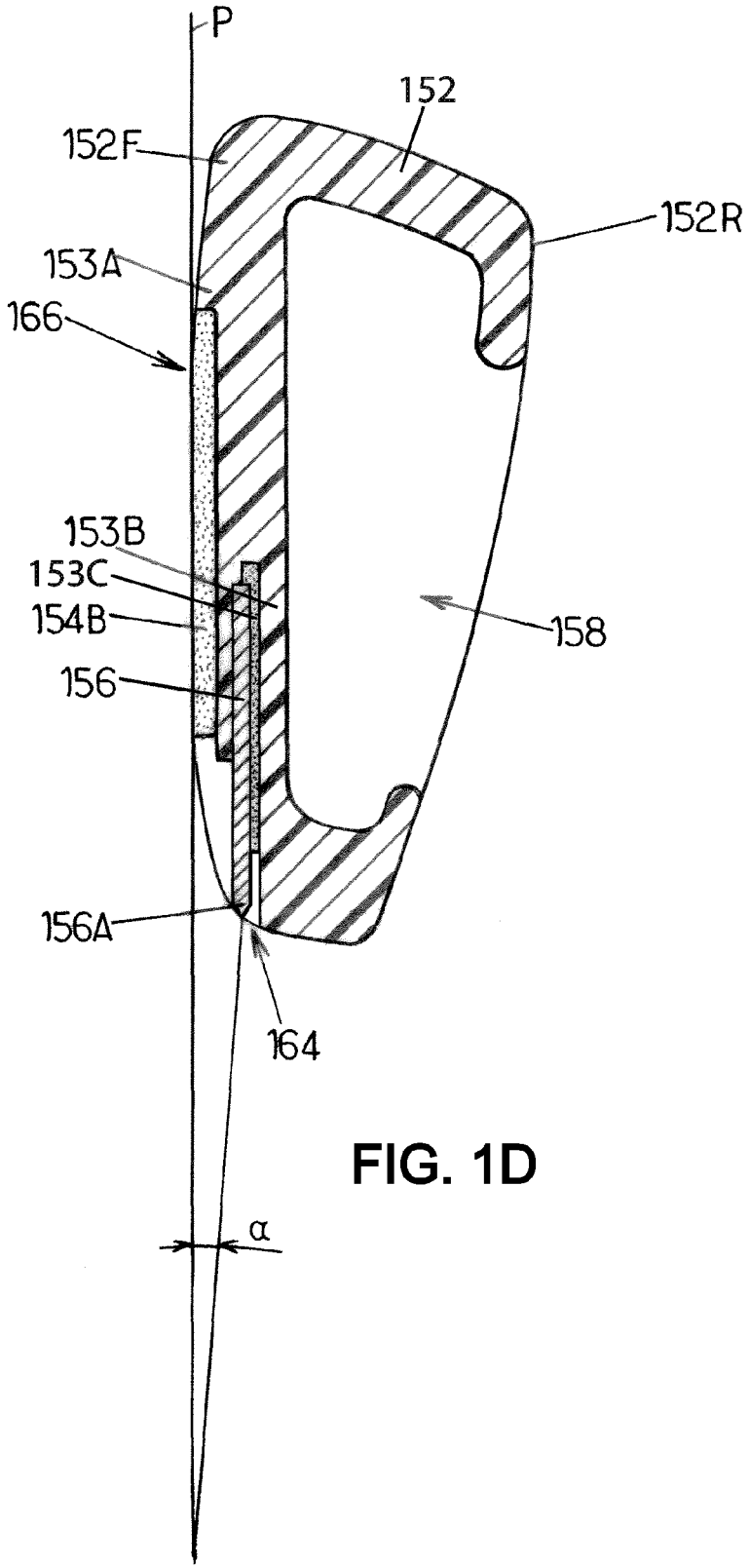
FIG. 1D is a partial transversal section of the shaving assembly of FIG. 1C along lines ID-ID, the shaving cartridge being released and the lock/release mechanism being in the head release position.
Figure 1E:
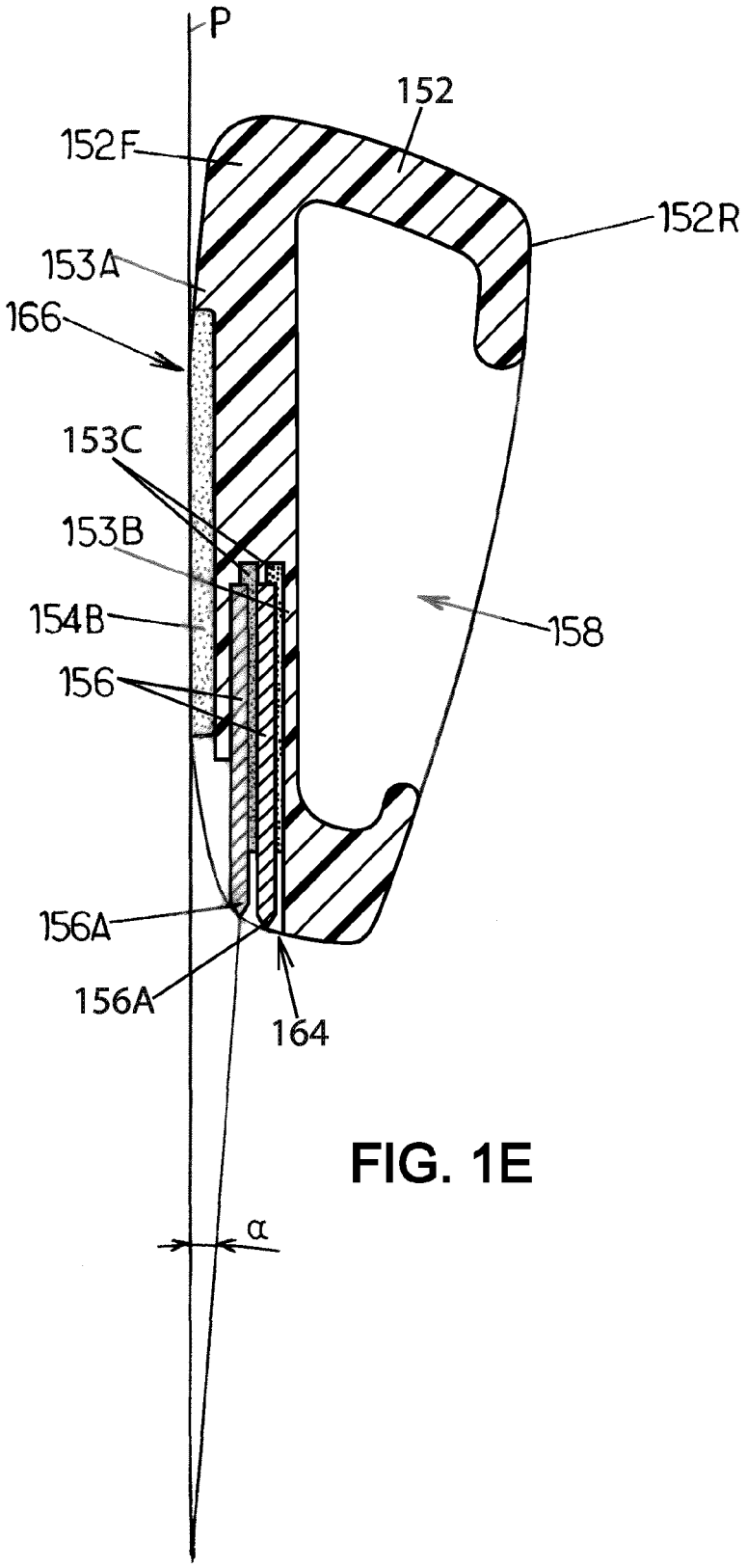
FIG. 1E is a partial transversal section of a shaving assembly, the housing being provided with several trimming blades.
Figure 1F:
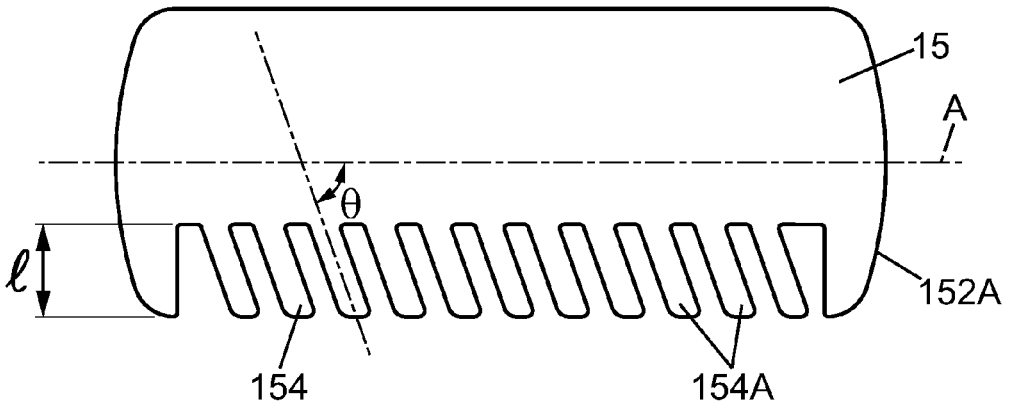
FIGS. 1F to 1L are top schematic views of a protective cover according to various embodiments.
Figure 1G:
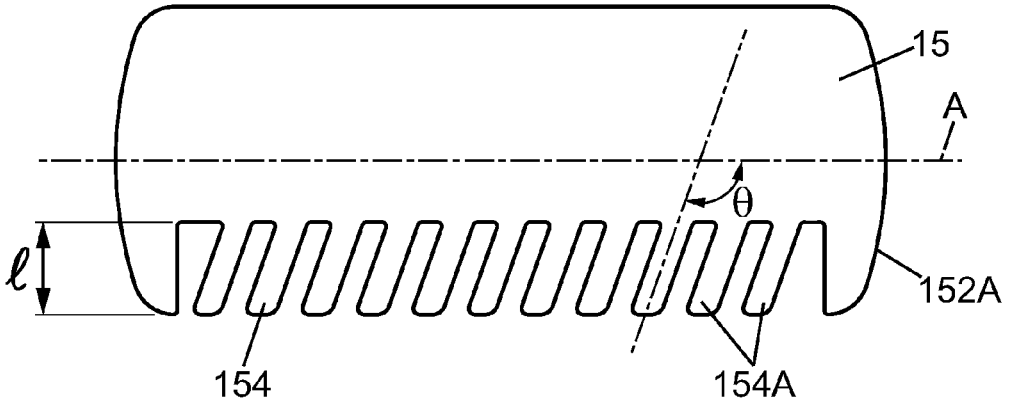

The angle θ can for instance be about 70° as depicted schematically on FIG. 1F or of 110° as depicted schematically on FIG. 1G. All the teeth are on FIGS. 1F and 1G skewed, or inclined, in the same direction (right or left).

Figure 1H:
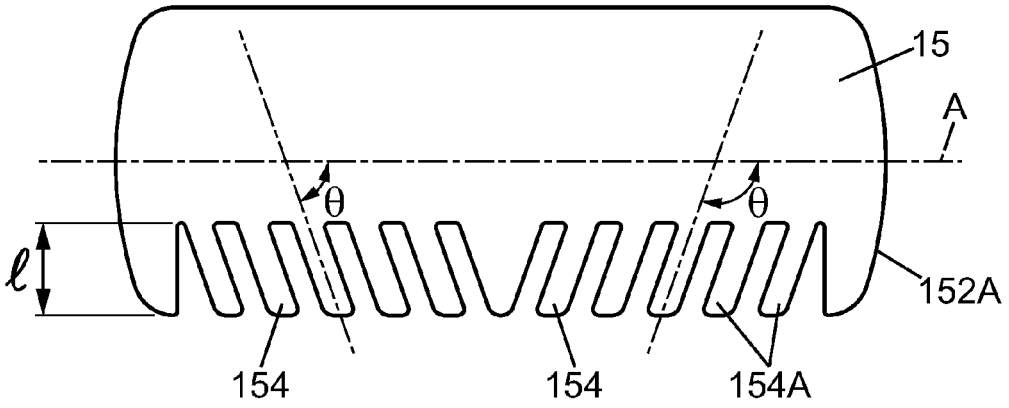

The comb 154 as depicted schematically on FIG. 1H comprises for instance a first half of the teeth projecting obliquely toward the right of the comb 154 and the second half of the teeth projecting obliquely toward the left of the comb 154. The angle θ can for instance be about 70° for the first half of the teeth and of 110° for the second half of the teeth.

Figure 1I:
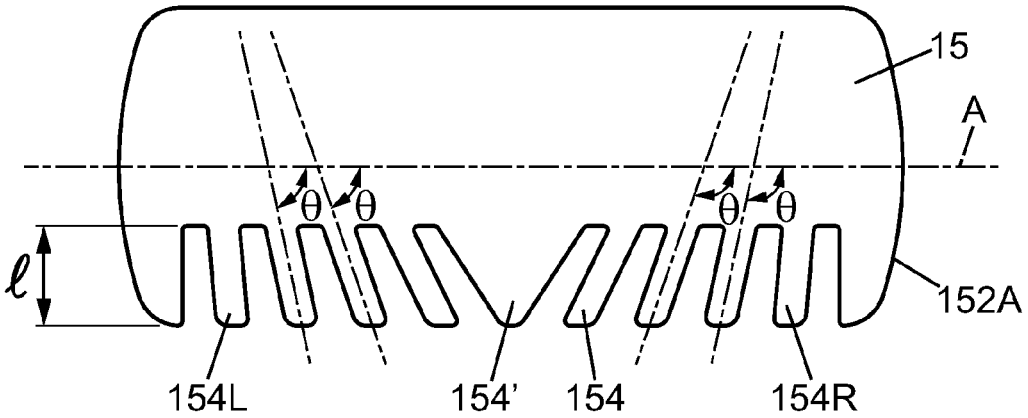

The comb 154 as depicted schematically on FIG. 1I is similar to the one depicted on FIG. 1H, but the angle θ varies from one tooth to the other one. The first half of the teeth projecting obliquely toward the right of the comb 154 may have an angle θ decreasing from the tooth 154L farthest from the center to the one 154' located in the center, whereas the second half of the teeth projecting obliquely toward the left of the comb 154 may have an angle θ increasing from the tooth 154R farthest from the center to the one 154' located in the center. The angle θ can for instance vary from about 90° to 45° for the first half of the teeth, whereas it may vary from about 90° to 135° for the second half of the teeth.

Figure 1J:
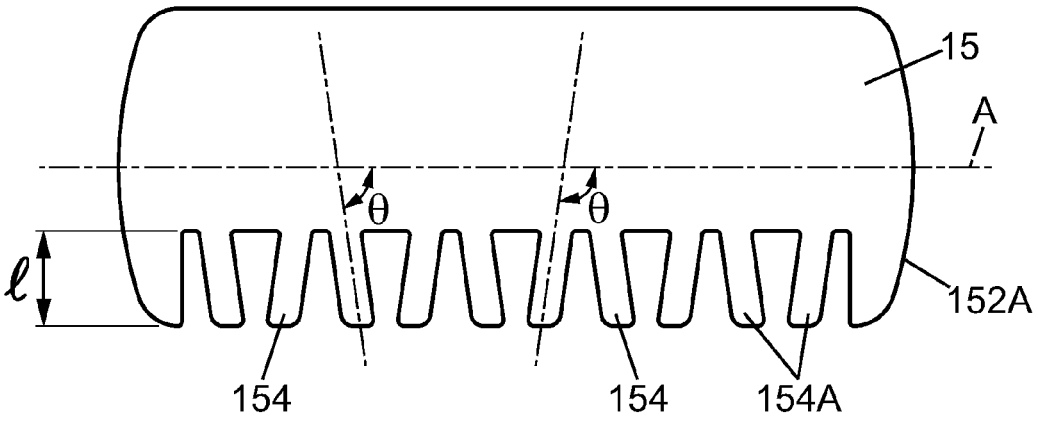

The comb 154 as depicted schematically on FIG. 1J is provided with teeth projecting such that they form a "zig-zag" path. More precisely, the teeth can project obliquely alternatively toward the right and toward the left from one tooth to the adjacent one. The angle θ may be equal or may increase or decrease from the tooth to the next tooth inclined in the same direction (right or left).

Figure 1K:
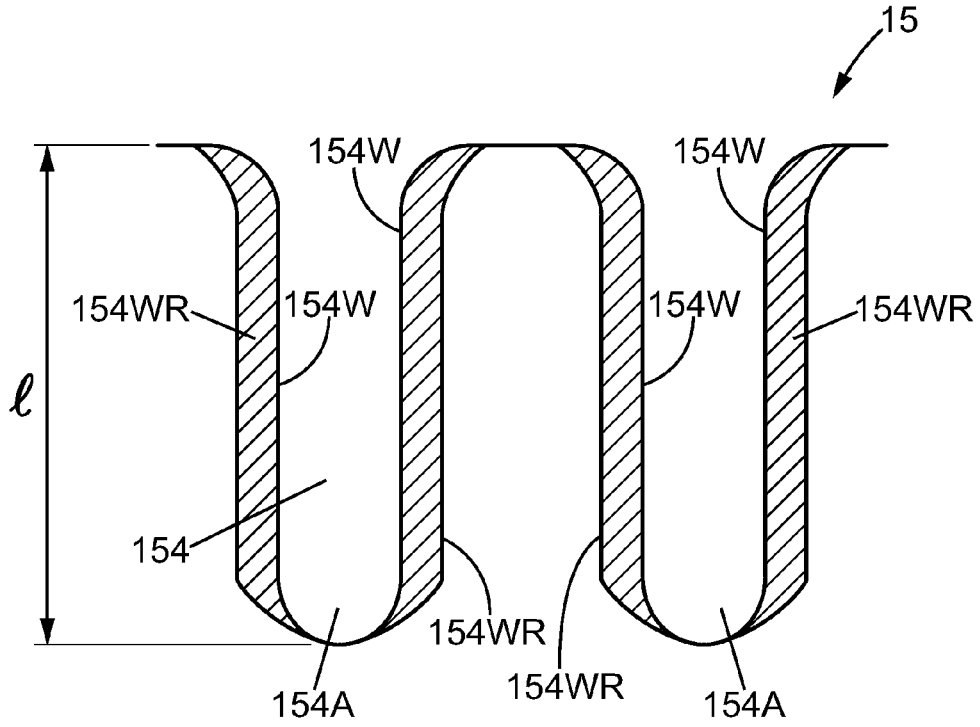

Besides, whatever the embodiment the teeth 154A can further be provided with an additional coating or overmolding on their walls. As depicted schematically on FIG. 1K, the inner walls 154W of the teeth 154A are provided with an additional material 154WR like rubber for instance in order to increase friction at the hair contact and help align the fair being cut even further. This also leads to a better gripping of the hair during the cut.

Figure 1L:
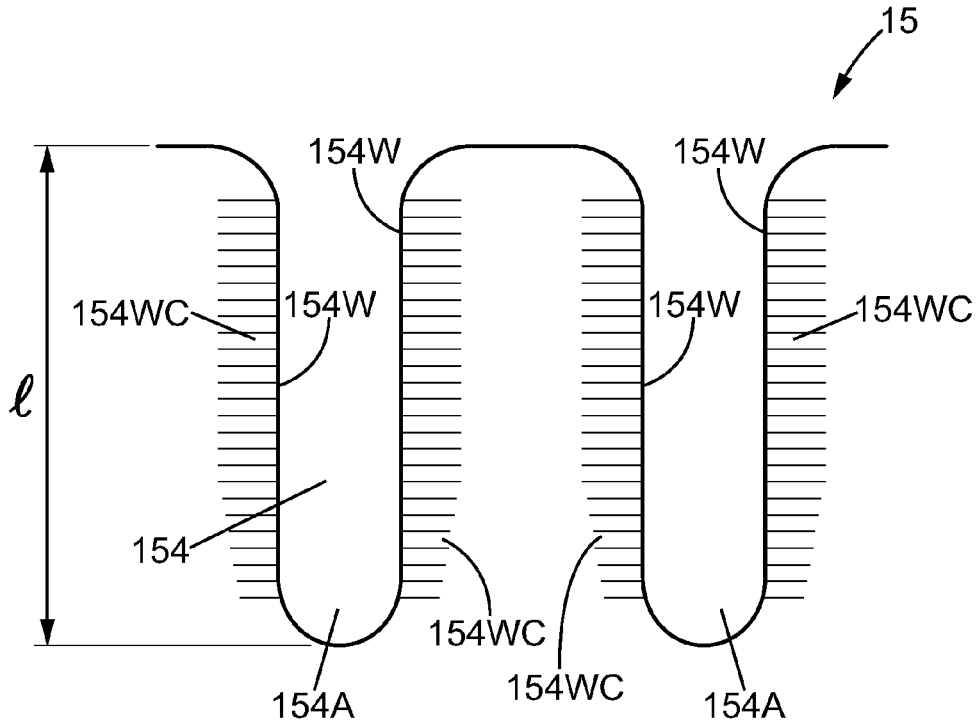

As depicted schematically on FIG. 1L, instead of rubber walls 154WR, a toothbrush like hairs of rubber or plastic 154WC can also be provided on the inner walls 154W of the teeth 154A in order to help with the alignment of the hair to be cut.

The length l of the teeth 154A measured from the longitudinal forward edge 152B of the housing 152 can be the same for all of them as illustrated on FIGS. 2A-2F or can vary in being for instance greater from the sides 152A to the center 152C of the housing 152 as illustrated on FIGS. 1A-1E where the teeth follow a curved path as best seen on FIG. 1C. Actually, as for the height H154, the length l of the teeth 154A can vary from one comb to another comb, and/or may also vary from one tooth to the other, on a same comb. The length l of the teeth 154A can be comprised between 5 mm and 40 mm, preferably between 10 mm and 30 mm and/or preferably between 5 mm and 25 mm.

Figure 3:
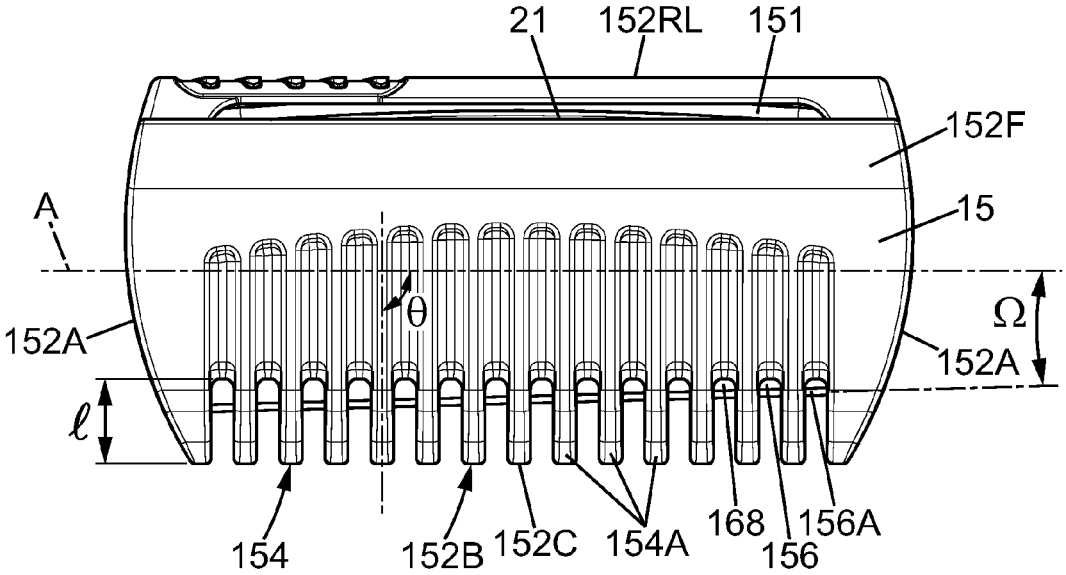
FIG. 3 is a top view of a protective cover according to another embodiment, the protective cover covering a shaving cartridge.
Figure 4A:
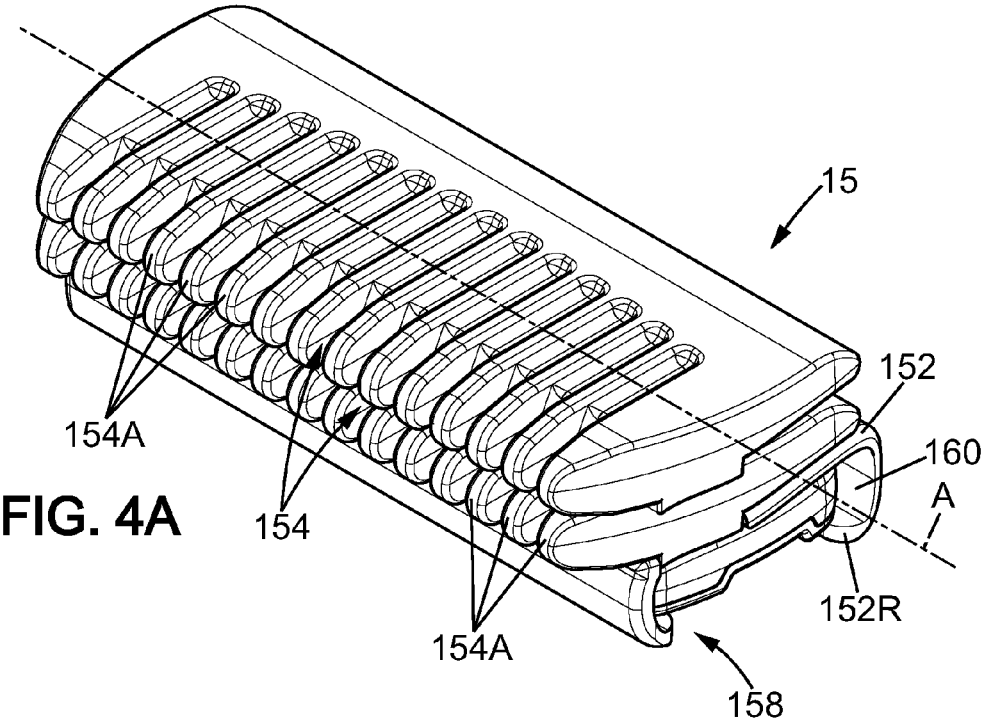
FIG. 4A is a perspective view of the protective cover according to another embodiment.
Figure 4B:
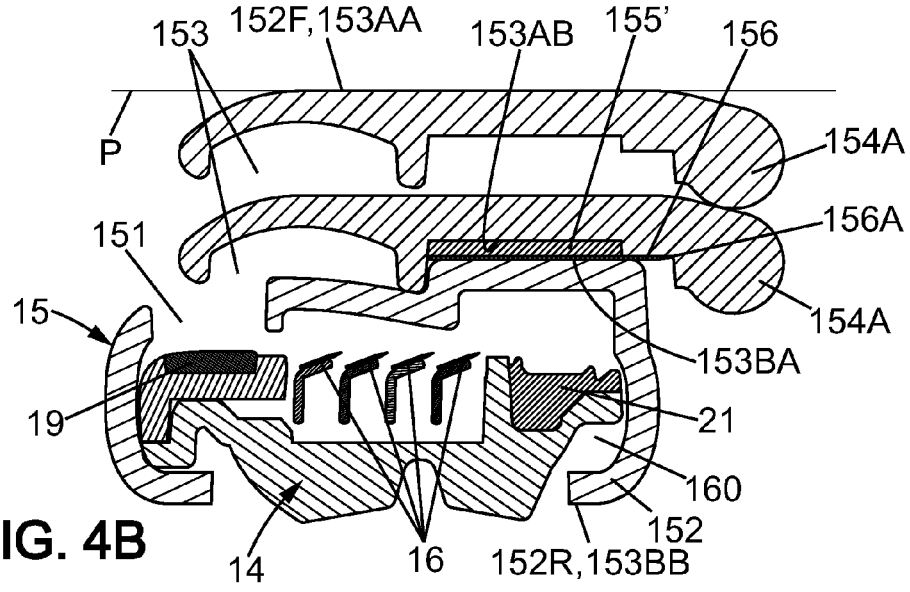
FIG. 4B is a sectional view of the protective cover of FIG. 4A.

Besides, the protective cover 15 may be provided a sole comb 154 or with several combs 154. As depicted on FIGS. 4A and 4B, the protective cover 15 can comprise two combs 154. Each of these combs 154 can be provided with the features defined here for one comb. More precisely, for instance, the teeth of the combs 154 can be transversal to the longitudinal axis A in being perpendicular or skewed. The inner wall of the teeth 154A can be provided with an additional coating or a toothbrush like hairs of rubber or plastic. The number, length and height of the teeth may vary among the combs and from one comb to the others. Besides, only one comb 154 can be provided with one or more trimming blade(s) or each of the combs 154 can be provided with one or more trimming blade(s). As depicted on FIGS. 3A and 3B, only one of the two combs 154 is provided with a trimming blade 156.

The housing 152 comprises a front face 152F and a rear face 152R, the trimming blade 156 and the comb 154 being provided onto the front face 152F, whereas the rear face 152R is provided with a rear opening 158 (see FIGS. 1D-1E, 2C-2D, 2F, and 6B-6C) through which the connecting members 28 of the shaving cartridge 14 covered by the protective cover 15 are accessible for the connection to the razor handle 12. Actually, the razor handle 12 extends through the opening 158 when the protective cover 15 is slid onto the shaving cartridge 14 and when the razor handle 12 is attached to the shaving cartridge 14.

Figure 6A:
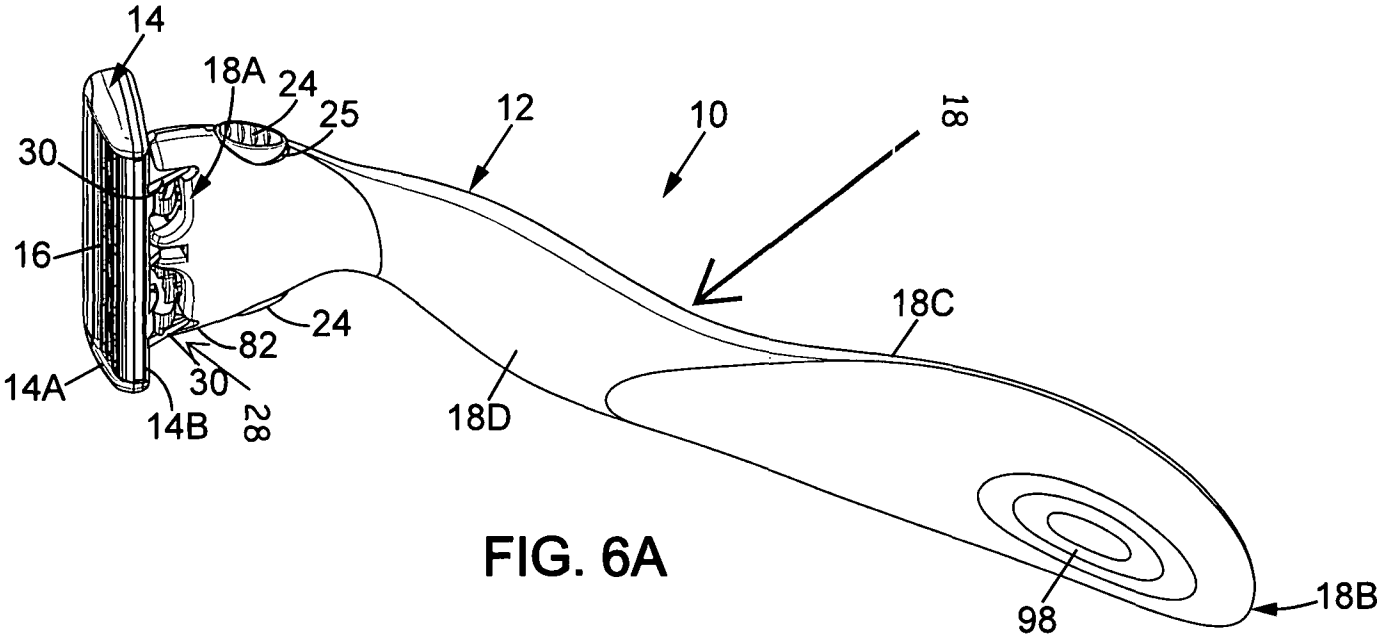
FIG. 6A is a perspective view of the razor shown in FIG. 1A, the shaving cartridge being connected to the razor handle.
Figure 6B:
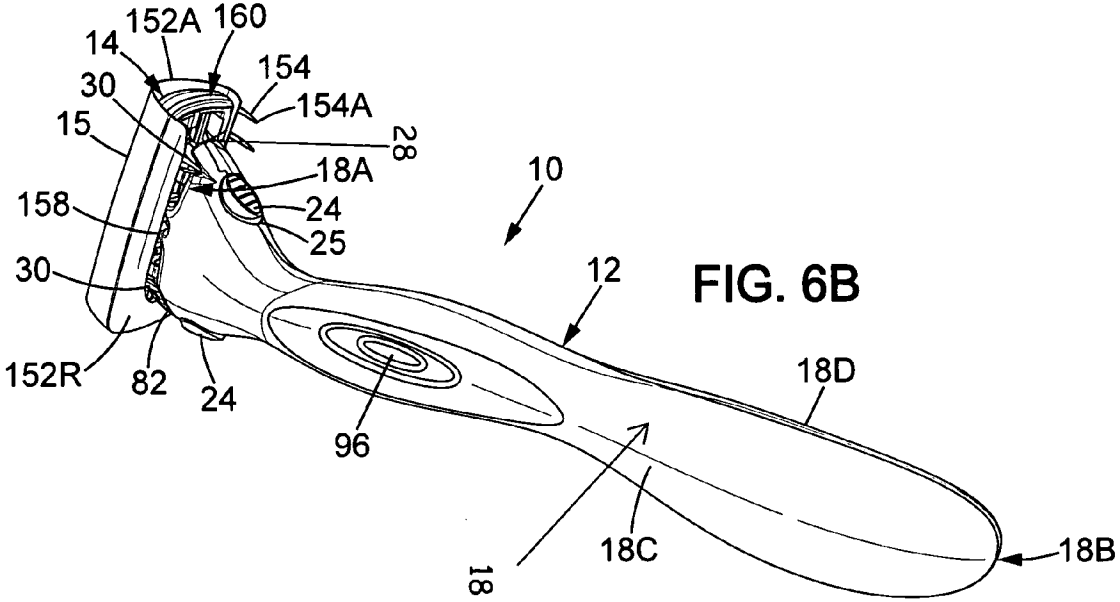
FIG. 6B is a perspective top view of the razor shown in FIG. 1C, the shaving cartridge being connected to the razor handle and the protective cover being put on the shaving cartridge.
Figure 6C:
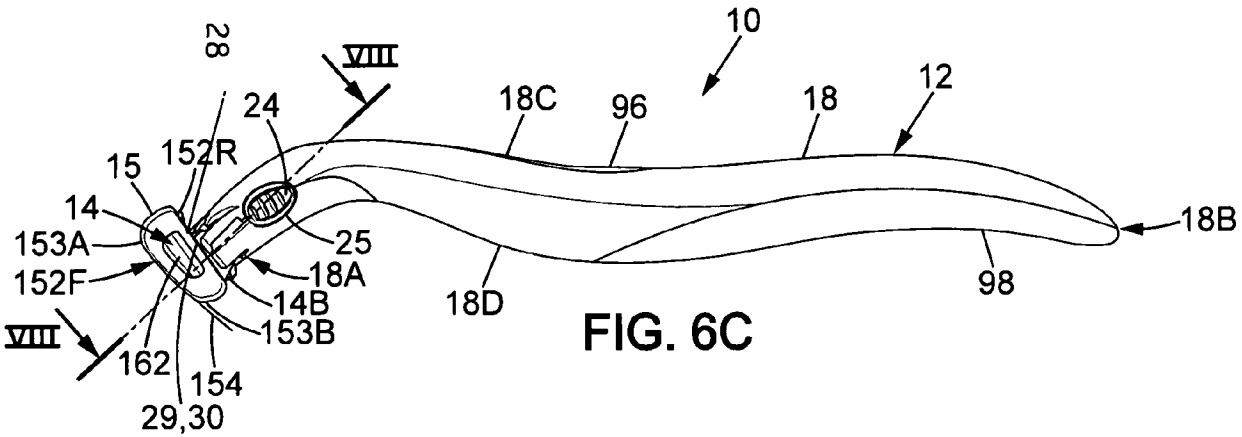
FIG. 6C is a side view of the razor shown in FIG. 1A, the shaving cartridge being connected to the razor handle and the protective cover being put on the shaving cartridge.

When provided on the shaving cartridge 14, the comb 154 and the trimming blade 156 are thus located on the front face 10A of the razor 10, opposite to the connection with the handle 12 as best illustrated on FIGS. 1C, 6B and 6C.

The comb 154 includes the teeth 154A and a rear part 154B from which the teeth 154A protrude forwardly. The comb 154 can be molded in two separate parts preferably corresponding to the teeth 154A and to the rear part 154B or can be molded in one single piece. The comb 154 can be directly molded onto the front face 152F of the housing 152 like a kind of over-molding or can be molded with the front face 152F according to the manufacture process (molding bi-injection, etc.). In both cases, the teeth protrude forwardly with regard to the housing 152 and extend beyond the housing 152 and the trimming blade 156.

The comb 154 is preferably made of a plastic material; the plastic material can be same as that used for the housing 152, more specifically for the rest of the housing 152, or can be different in being for instance softer. Besides, the plastic used for the comb 154 can have a different color than that used for the housing 152, more specifically for the rest of the housing 152.

The housing 152 is preferably composed of an upper part 153A and a lower part 153B, the comb 154 being provided on the upper part 153A and the trimming blade 156 being located between the upper part 153A and the lower part 153B. The housing 152 of the protective cover 15 can be manufactured in one single piece or, in order to facilitate the manufacture of the protective cover 15, it can include several parts assembled together by known assembling means like crimping, welding, etc.

As already mentioned above the comb 154 and the rest of the housing 152 can be of the same material or can be different, the same applies for the upper part 153A and the lower part 153B when they are two separate pieces.

According to a first embodiment, the upper part 153A and a lower part 153B of the housing 152 can be one single piece as depicted on FIG. 1D in which the front face 152F of the housing 152 is preferably composed of an upper part 153A and a lower part 153B, the comb 154 being provided on the upper part 153A and the trimming blade 156 being located between the upper part 153A and the lower part 153B.

Figure 2A:
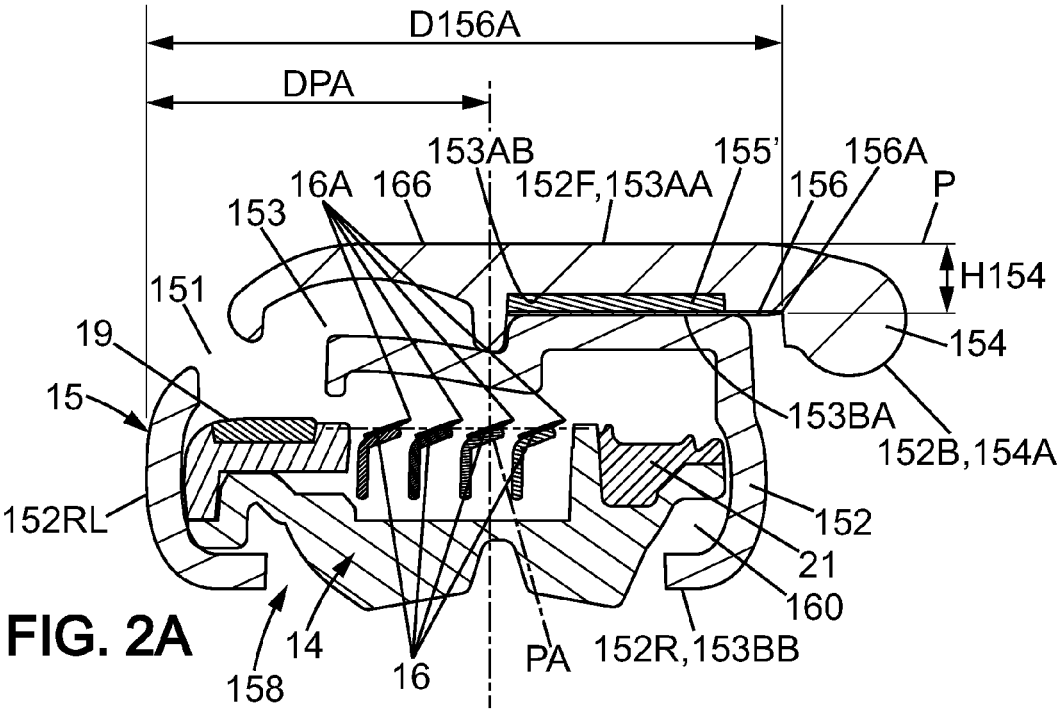
FIG. 2A is a transversal section of a protective cover according to another embodiment covering a shaving cartridge.
Figure 2B:
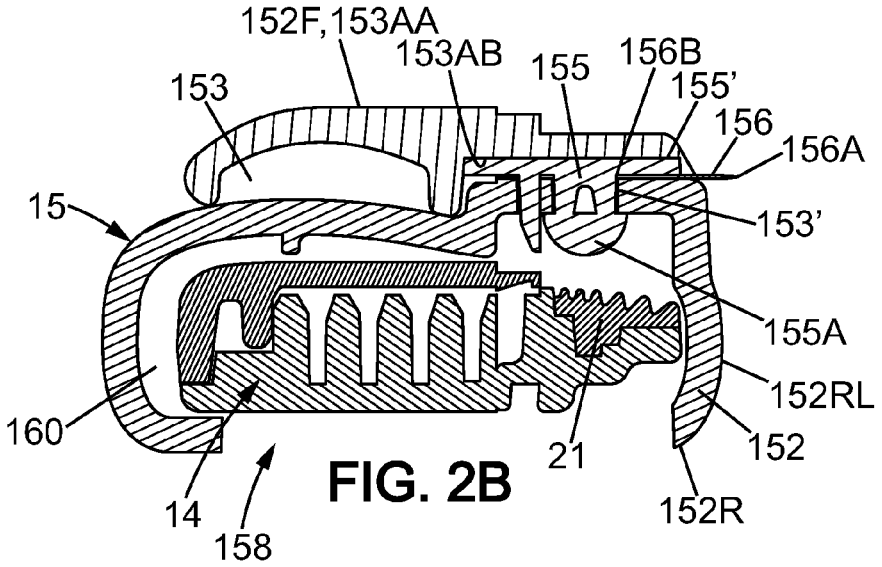
FIG. 2B is a partial transversal section of the protective cover of FIG. 2A covering a shaving cartridge.

According to a second embodiment, the housing 152 can be made of at least two separate pieces as depicted on FIGS. 2A and 2B. More precisely for that second embodiment, the upper part 153A and a lower part 153B of the housing 152 are forming respectively a comb part and a cover part. In that case, the comb 154 is provided on the upper part 153A. The trimming blade 156 is located between the upper part 153A and the lower part 153B, more specifically between the lower face 153AB of the upper part 153A (opposite to the front face 153AA corresponding to the front face 152F of the housing 152) and the upper face 153BA of the lower part 153B (opposite to the lower face 153BB corresponding to the rear face 152R of the housing 152).

Besides, when the housing 152 is made of several separate parts as depicted on FIGS. 2A and 2B, a cavity 153 is provided between the upper part 153A and the lower part 153B, in order to ensure that there is no water trapped between these two mating parts. Actually, this cavity 153 prevents bacteria or mold growth that could occur due to humidity that may appear in the small gap created by the two mating parts and bad air circulation. This cavity 153 is sufficiently large to promote air flow for quick drying and makes also harder the formation of water stagnation droplets.

Figure 2D:
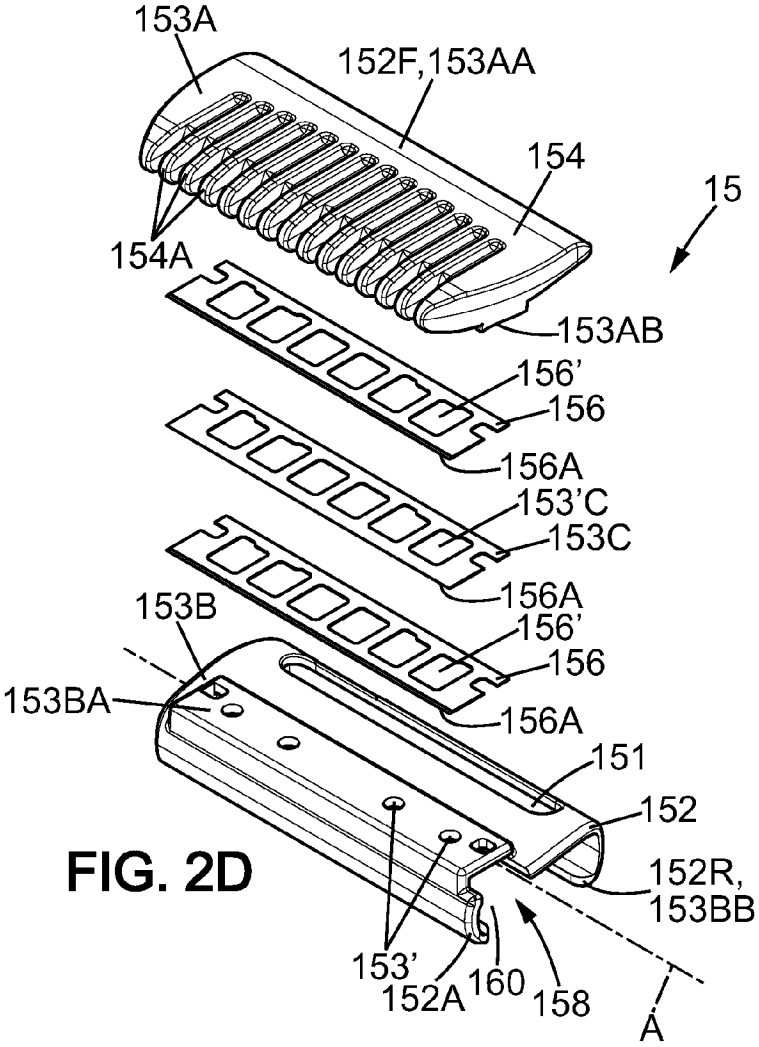
FIG. 2D is an exploded perspective view of the protective cover according to another embodiment without the shaving cartridge, the housing being provided with several trimming blades.
Figure 2C:
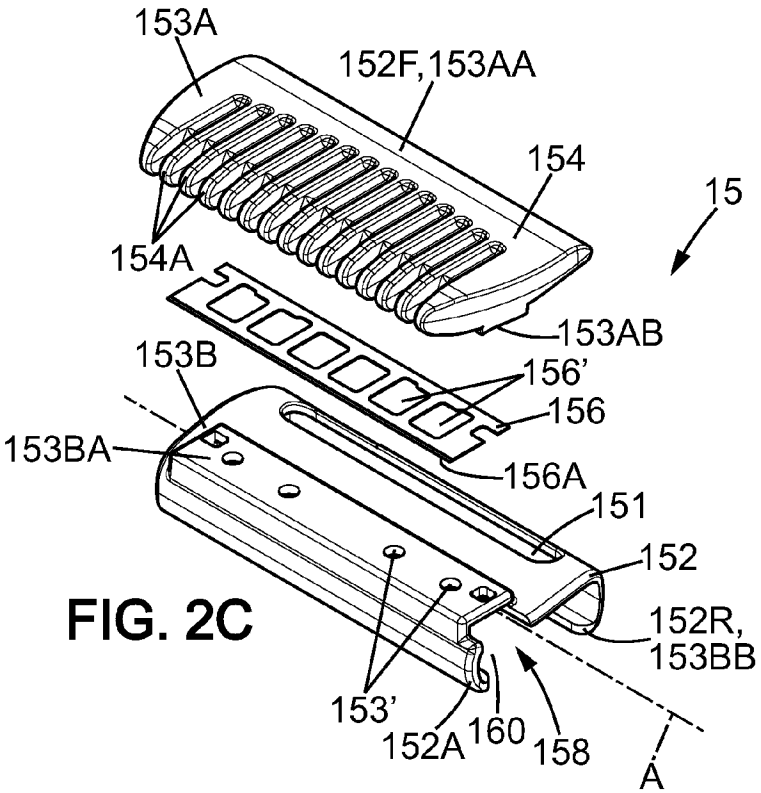
FIG. 2C is an exploded perspective view of the protective cover of FIG. 2A without the shaving cartridge.

Besides, as illustrated on FIG. 2C, the trimming blade 156 can be put directly between the upper part 153A and the lower part 153B of the housing 152 or as illustrated for instance on FIG. 1D, a spacer 153C can be put directly between the trimming blade 156 and the lower part 153B of the front face 152F of the housing 152.

Besides, the trimming blade 156 can be fixed (meaning motionless) and unreleasably mounted in the housing 152 for instance in being rivet mounted in the housing 152 or can be movably mounted in it for instance with elastic fingers (not illustrated) allowing the trimming blade 156 to move when shaving forces are applied on it.

The protective cover 15 can further be provided with a forwardly skin contacting surface 164 located forward of the trimming blade 156 and a rearwardly skin contacting surface 166 located rearward of the trimming blade 156.

Besides, the rearwardly skin contacting surface 166 is preferably a highly polished (glossy) surface in order to have a low friction coefficient that promotes dry shavings. A very low friction surface on the comb 166 can also be provided for instance with a high polished surface on the mould cavity (32 μm, 16 μm or even 8 μm type finish) used for manufacturing the comb 166.

Besides, the trimming blade 156 can be parallel to a plane P tangential to the rearwardly skin contacting surface 166 or can be inclined at an angle $\alpha$ with regard to that plane P. In that case, the angle $\alpha$ is preferably comprised between 0 and 30°, the trimming blade 156 and more precisely its edge 156A being inclined forwardly in direction to the plane P.

Besides, several trimming blades can be provided on the housing 152 as depicted on FIGS. 1E and 2D. In that case, the trimming blades 156 are stacked one above the other and can be separated with spacers 153C as detailed hereafter. This combination of blade(s) and spacer(s) gives the ability to have one or more blades to act as a trimmer.

Further, the trimming blades 156 can also be parallel to the plane P or can be inclined at an angle $\alpha$ with regard to that plane P.

The protective cover 15 is preferably not provided with any kind of connecting member allowing the connection to the razor handle. It is also preferably not in contact with any part of the razor handle 12. Actually, as detailed hereafter the shaving cartridge 14 can be pivotally connected to the razor handle 12 and in that case, when the protective cover 15 is put onto the shaving cartridge 14 it is also pivotally connected to the razor handle 12 via the shaving cartridge 14 and more precisely via the connecting members 28 of the shaving cartridge 14.

The location of the trimming blade(s) 156 and more specifically of it/their cutting edge 156A is chosen in order to offer the best arrangement for manageability and stability of the protective cover 15 used as a trimmer.

More specifically and as depicted for instance on FIG. 2A, the pivot axis PA of the shaving cartridge 14 is located roughly in the middle of the protective cover 15. Actually, the pivot axis PA of the shaving cartridge 14 is located at a distance DPA from the rear longitudinal face of the protective cover 15, more specifically from the rearmost longitudinal face 152RL of the housing 152 (opposite the longitudinal forward edge 152B of the housing 152). In comparison with the distance D156A to the trimming blade edge 156A from the rearmost longitudinal face 152RL, the distance DPA is more or less of half value. For instance, DPA is of about 9 mm to 11 mm, preferably of about 10 mm, whereas D156A is of about 17 mm to 22 mm, preferably of about 18 mm.

This arrangement offers a limited range of motion of the trimming blade(s) 156 which enhances the safety perception and allows more precise control of the trimming blade(s) 156 especially in hard to reach areas. This is because the shaving force applied by the user is uniformly distributed over the whole of the trimmer surface due to the symmetrical pivot center (roughly in the middle of the trimmer system). Also the closer distance of the pivot axis to the trimming blade edge 156A and the flat surface formed by the rearwardly skin contacting surface 166 which is parallel and above the blade gives an advantage because the flat skin contacting surface pushes at the axis location and always maintain contact with the skin. Thus, such a location avoids rotation of the shaving cartridge 14 thus lifting the trimmer blade(s) 156 off the skin.

The rear opening 158 can lead in a lateral opening 160 provided on one of the lateral faces 152A of the housing 152 allowing the protective cover 15 to be slid onto the shaving cartridge 14 along arrow F.

An opposite lateral opening 162 can also be provided on the other of the lateral faces 152A of the housing 152 in order to make easier the sliding of the protective cover 15 especially in allowing the air pressed by the shaving cartridge 14 inside the protective cover 15 when it is being slid onto the cartridge.

When the protective cover 15 is completely put onto the shaving cartridge 14, it covers at least the edges of the shaving blades 16 of the shaving cartridge 14. Actually, as depicted on the figures, the protective cover 15 covers completely the shaving blades 16 when it is put onto the shaving cartridge 14. Especially, no opening or access is possible to the shaving blades 16 through the protective cover 15, when the last is completely put onto the shaving cartridge 14. Therefore, the protective cover can absolutely protect the shaving blades and the user cannot get injured with them.

As indicated above, the trimming blade 156 is elongated along longitudinal axis A and the wash through opening 168 is also elongated along longitudinal axis A. When the protective cover 15 is attached onto the shaving cartridge 14 for instance after having being slid onto the shaving cartridge 14, the trimming blade 156 can be parallel to the one or more shaving blades 16. Actually, when parallel to the shaving blade(s) 16, the shaving blades 16 are also elongated along longitudinal axis A. The shaving blades 16 are preferably perpendicular to the longitudinal direction/axis L of the handle body 18; therefore the longitudinal axis A is perpendicular to the longitudinal direction L when the protective cover 15 is put onto the shaving cartridge 14 attached to the razor handle 12.

Besides, the length of the trimming blade 156 can be of the same value than that of the shaving blades 16, but it is preferably shorter in order to have a more precise shaving with the trimming blade 156 than with the shaving blades 16.

In order to be able to be washed and to evacuate the cut hair, the protective cover 15 is provided with a wash through opening 168 located in front of the trimming blade 156. To ensure that the shaving blade 14 does not get dirty when the protective cover 15 is used for shaving, this wash through opening 168 is offset from one relative to the longitudinal forward edge 14' of the shaving cartridge 14.

More precisely, when the protective cover 15 is put on the shaving cartridge 14, the wash through opening 168 is offset by being more forward than the housing of the shaving cartridge 14. The value of the offset between the wash through opening 168 and the longitudinal forward edge 14' is preferably between 0 mm and 5 mm.

Besides, the protective cover 15 can be provided with a back ventilation opening 151 as depicted on FIGS. 2A-2C and 2E. This back ventilation opening 151 is preferably located at the back of protective cover 15 opposite to the comb teeth 154A in order to allow the lubra 21 of the shaving cartridge 14 to dry after use for traditional shaving. Actually, when shaving traditionally (i.e. with the shaving cartridge 14, the protective cover 15 being removed), the lubra 21 becomes wet. As depicted on FIGS. 2E and 2F, when the protective cover 15 is put onto the shaving cartridge 14 after traditional shaving the back ventilation opening 151 prevents sticking of the lubra 21 onto the protective cover 15 that could occur due to swelling of the lubra 21 when wet. The back ventilation opening 151 thus prevents the shaving cartridge 14 and more precisely its lubra 21 from being damaged.

A method of manufacturing such a protective cover 15 will now be described. The method preferably comprises the steps of providing an upper part 153A having a lower surface 153AB and including securing pins 155 protruding from the lower surface 153AB.

providing a trimming blade 156 having trimming blade apertures 156' in alignment with the securing pins 155, mounting the trimming blade 156 onto upper part 153A, the securing pins 155 passing through the trimming blade apertures 156', providing a lower part 153B having securing apertures 153' in alignment with the securing pins 155, mounting the lower part 153B onto the trimming blade 156, the securing pins 155 passing through the securing apertures 153', forming a crimping head 155A at one end of each securing pin 155, thereby irremovably riveting both the trimming blade 156 and the upper part 153A onto the lower part 153B.

The securing pins 155 can be formed as a single piece with the upper part 153A or they can be separate pieces. In that last case, the method further comprises the steps of providing a securing pins member 155' comprising the securing pins 155 as depicted on FIGS. 2A and 2B, fixedly attaching the securing pins member 155' onto the lower surface 153AB of the upper part 153A.

The securing pins member 155' can for instance be over-molded onto the upper part 153A, more specifically onto its lower surface 153AB. In that case, the securing pins member 155' and the upper part 153A can be made of different materials. The material combinations could give the advantage of hiding or enhancing the visibility of the trimming blade by changing the color or material type or by enhancing the trimming blades appearance by allowing the use of printing or in mould labeling of the securing pins member 155' before it is over-moulded with the upper part 153A. Thus, graphics applications can be provided to communicate the customer logos, images or other information. This can be achieved through thermal printing, IML or other existing applications.

The material used can comprise a plastic material harder than the one used for the comb 154 which is preferably soft.

When the protective cover 15 comprises several trimming blades, the method further comprises the steps of providing a spacer 153C having holes 153'C in alignment with the securing pins 155, mounting the spacer 153C onto the trimming blade 156, the securing pins 155 passing through the holes 153'C, providing a second trimming blade 156 having trimming blade apertures 156' in alignment with the securing pins 155, mounting the second trimming blade 156 onto the spacer 153C, the securing pins 155 passing through the trimming blade apertures 156', and forming a crimping head at one end of each securing pin 155, thereby riveting together the trimming blades 156, the spacer 153C and the upper part 153A onto the lower part 153B.

The above-mentioned steps are particularly adapted for a protective cover 15 comprising two trimming blades; however, one should understand that in order to manufacture a protective cover 15 comprising more than two trimming blades, these steps of providing a spacer and a second trimming blade should be repeated before mounting the lower part 153B onto the trimming blade 156 as many times as necessary, the securing pins 155 passing through the securing apertures 153', and than forming a crimping head 155A at one end of each securing pin 155, thereby irremovably riveting both the trimming blades 156, the spacers 153C and the upper part 153A onto the lower part 153B.

Besides, the razor can be a disposable one or can be a razor system in which the shaving cartridge thrown when the edge of the blade(s) is dulled. In that last case, the shaving cartridge 14 is a disposable one and a lock/release mechanism 20 is also provided as shown in greater details in FIGS. 7A-B and 8A-C and enables to selectively connect the shaving cartridge 14 to the razor handle 12 or release the shaving cartridge 14 in order to exchange shaving cartridges.

Figure 7A:
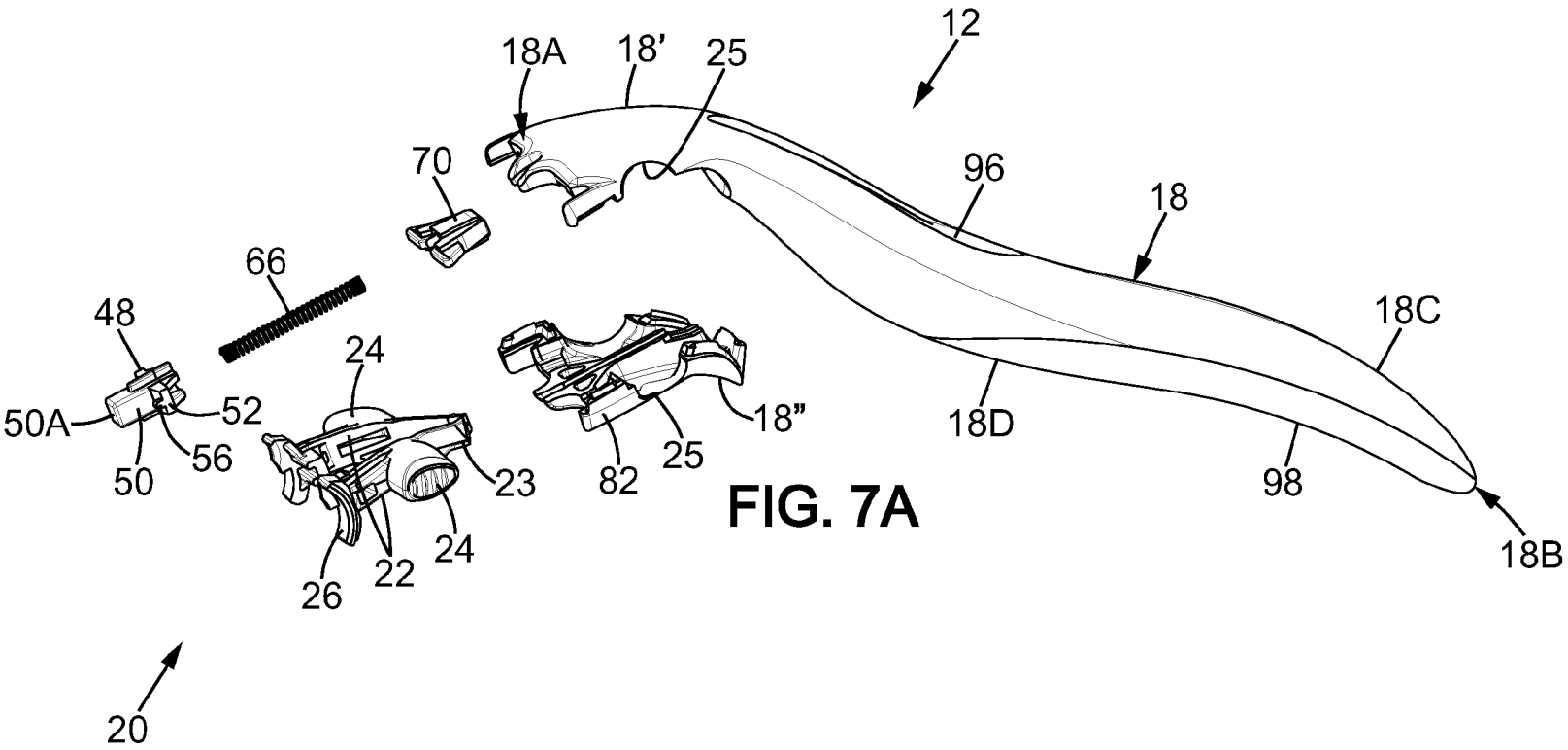
FIG. 7A is a perspective exploded view of the razor shown in FIG. 1A (without the shaving cartridge and without the protective cover).
Figure 7B:
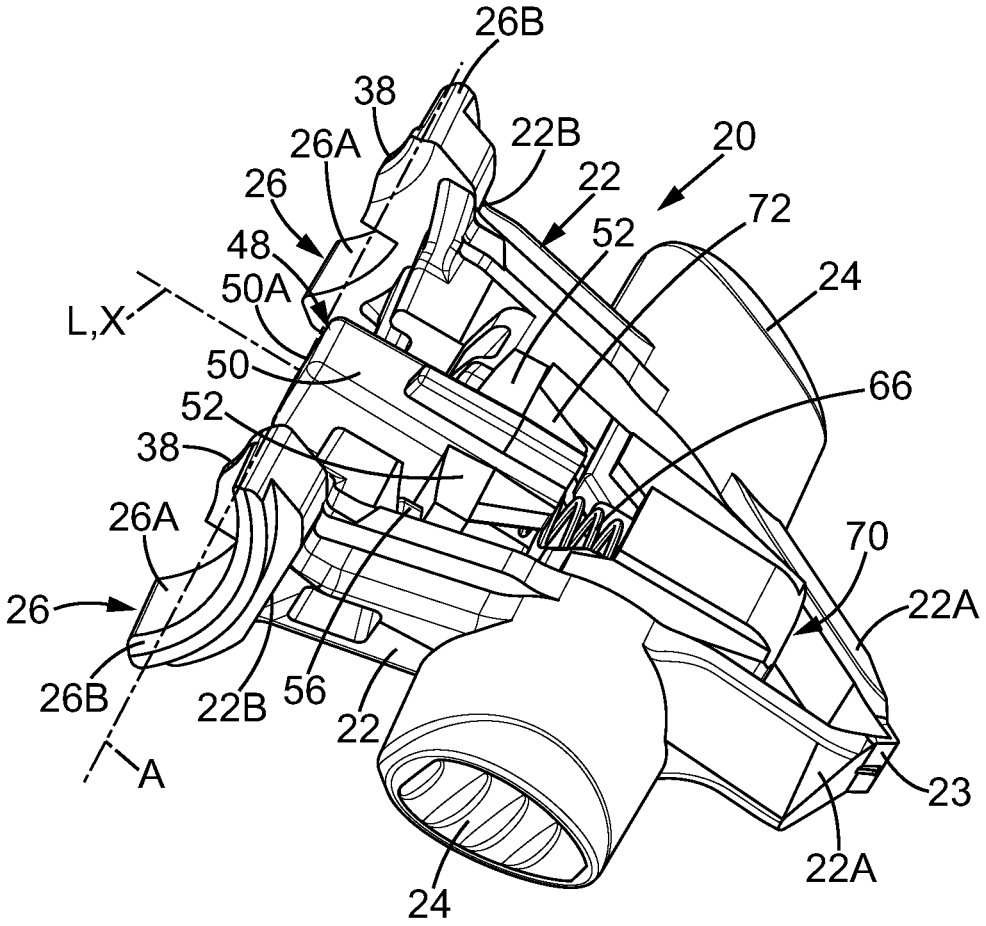
FIG. 7B is a perspective view of the lock/release mechanism shown in FIG. 7A (without the handle body).

The lock/release mechanism 20 is included in the handle body 18 which may therefore be in two parts 18' and 18" (see FIG. 7A). The lock/release mechanism 20 includes two arms 22 which can be made for instance out of molded plastic material. The two arms 22 may each extend from a first end 22A situated inside the handle body 18 toward a free end 22B which may protrude toward the outside at the front end 18A of the razor handle 12. The two arms 22 may be disposed in a V shape, diverging from a medial axis X from their first end 22A toward their respective free end 22B. The medial axis X is substantially parallel to the curved longitudinal axis L of the handle. The first ends 22A of the two arms 22 may be connected together by a hinge 23, formed for instance as a thin bridge of plastic material connecting the two arms 22 to each other when the arms are molded as a single piece. The hinge 23 may have a negligible resilient action, or no resilient action, on the two arms 22.

The two arms 22 further include respectively two pushbuttons 24 which may be formed integrally therewith and which may protrude laterally out of the handle body 18, for instance through two holes 25 formed in the handle body 18. The pushbuttons 24 may thus be surrounded by the handle body 18 in all directions around the holes 25.

The free ends 22B of the arms 22 may be provided with respectively two bearings, in particular two shell bearings 26 which are exposed toward the outside. The free ends 22B could also be provided with journal means or any known connecting means.

Each shell bearing 26 may for instance include a cylindrical concave front face 26A and a lateral edge 26B which protrudes outwardly and which has also a cylindrical shape. The two front faces 26A and the two lateral edges 26B have the same cylindrical axis, corresponding to the pivot axis of rotation of the shaving cartridge 14 which also correspond to the longitudinal axis A of the protective cover 15.

Figure 8A:
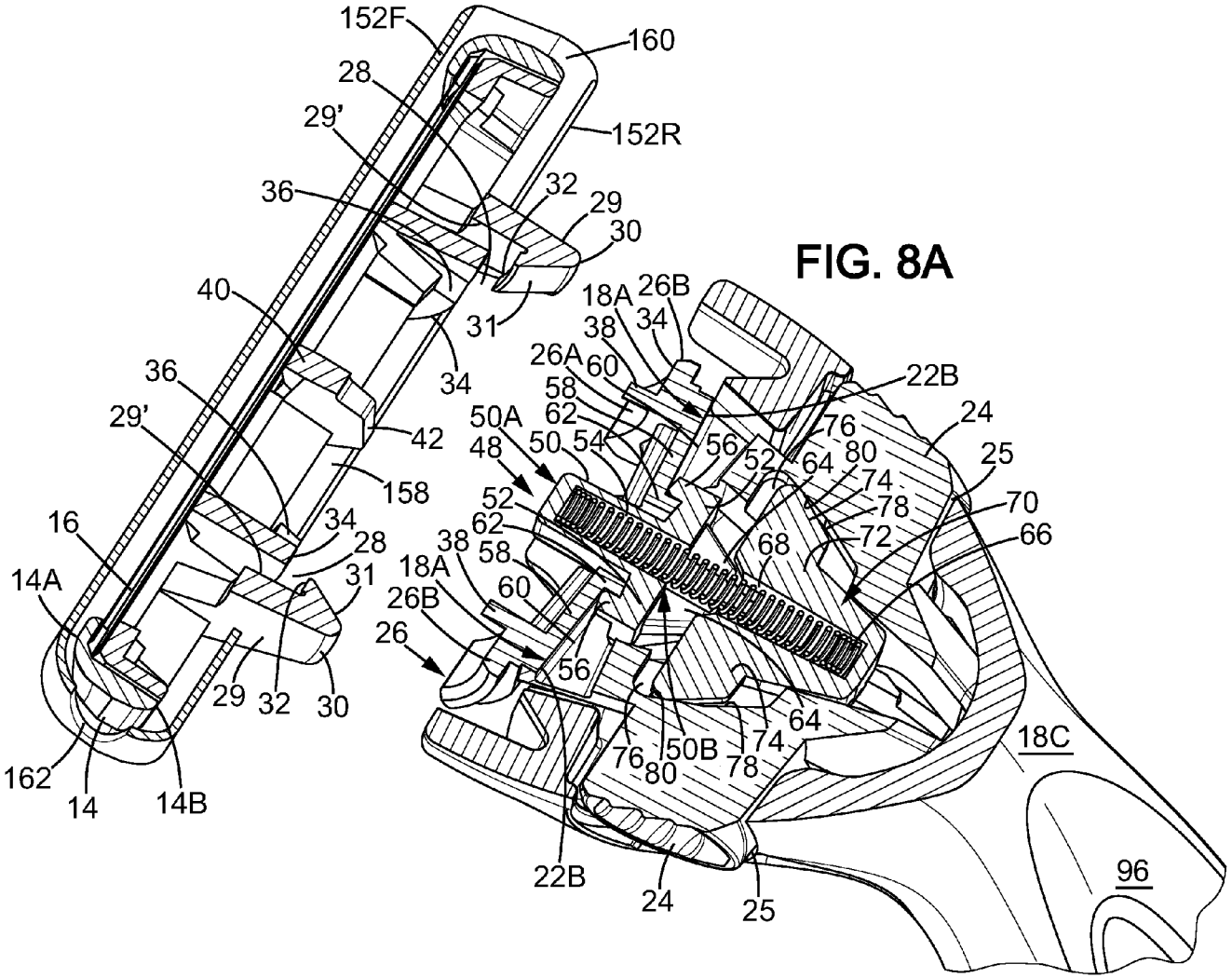
FIG. 8A is a partial longitudinal section of the razor of FIG. 6C along lines VIII-VIII, the shaving cartridge being released and the lock/release mechanism being in the head release position.
Figure 8B:
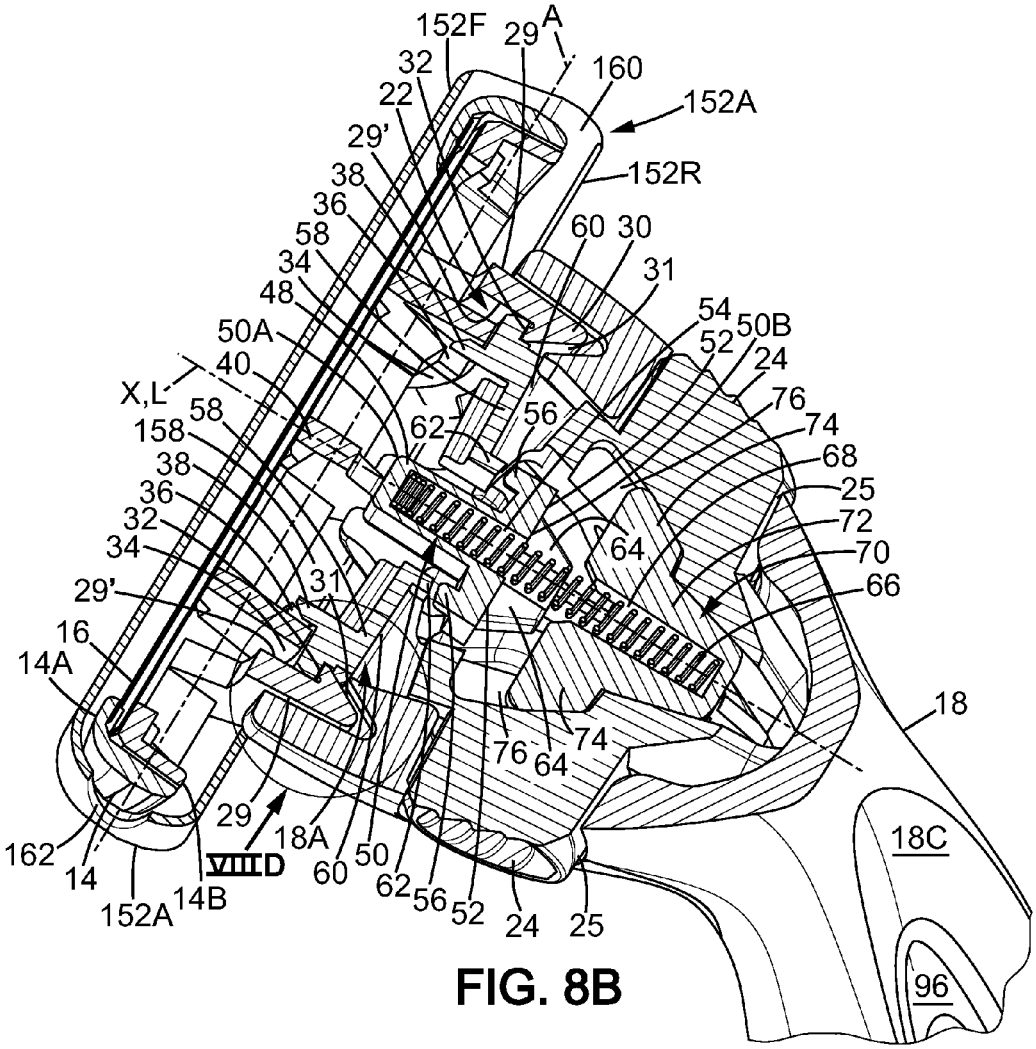
FIG. 8B is a partial longitudinal section of the razor of FIG. 6C along lines VIII-VIII, the shaving cartridge being connected to the razor handle and the lock/release mechanism being in the head lock position.
Figure 8D:
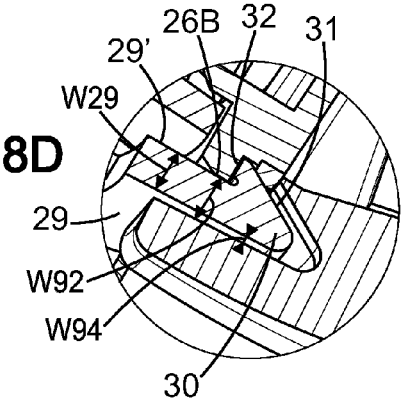
FIG. 8D is a view of detail VIIID of FIG. 8B.
Figure 8C:
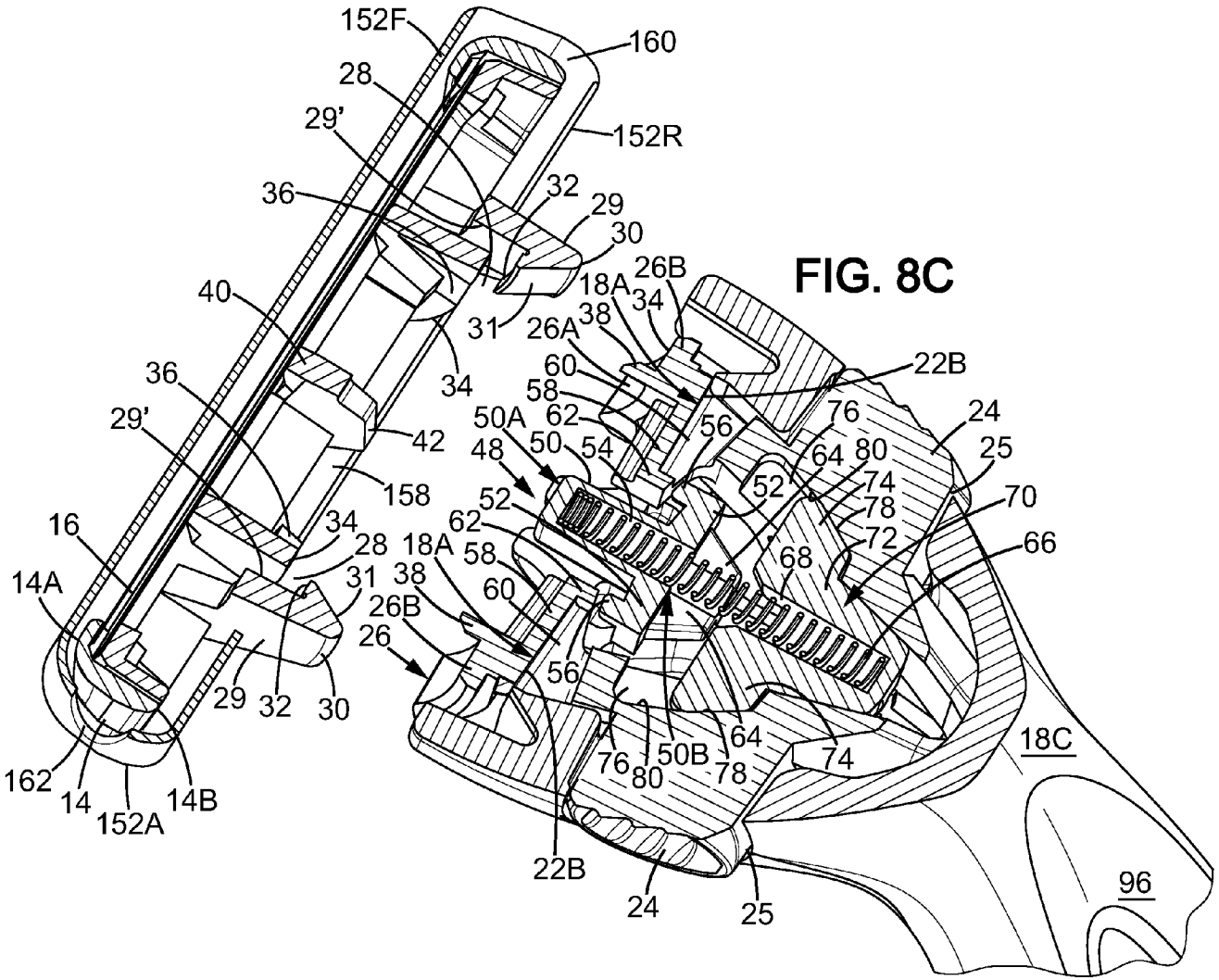
FIG. 8C is a partial longitudinal section of the razor of FIG. 6C along lines VIII-VIII, the shaving cartridge being release and the lock/release mechanism being in the head lock position.

In reference to FIGS. 8A, 8B and 8C, the arms 22 are elastically biased opposite to one another toward a head locking position (see FIG. 8B or 8C) and movable toward one another into a head release position (see FIG. 8A).

As shown in FIG. 8A, the rear face 14B of the shaving cartridge 14 may include two connecting members or rearwardly protruding connectors, i.e. two inwardly facing arcuate slots 28 shaped in correspondence with the lateral edges 26B of the shell bearings 26 and adapted to receive the lateral edges 26B for pivotally mounting the shaving cartridge 14 onto the handle 12. These arcuate slots 28 may be formed respectively in two protruding ribs 30 including two respective lateral surface 29 (and its corresponding internal face 29') and two respective inclined surfaces 31 facing each other and extending slantwise toward each other from the top of the ribs 30 toward the arcuate slots 28, so as to facilitate the insertion of the shell bearings 26 in the arcuate slots 28 and may be limited toward the handle 12 by a first arcuate concave surface 32 facing toward the shaving cartridge 14, and away from the handle 12, by a larger second arcuate convex surface 34 facing toward the handle 12.

The front faces 26A of the shell bearings 26 bear respectively on the second arcuate convex surfaces 34. The second arcuate convex surfaces 34 may include respectively two notches 36 for receiving corresponding protrusions 38 of the shell bearings 26, so as to limit the angular range of rotation of the shaving cartridge 14. The rear face 14A of the shaving cartridge 14 may further include a central rib 40 having an edge forming a top flat cam surface 42 facing away from the shaving cartridge 14 toward the handle 12.

In case of a disposable shaving cartridge and with reference to FIGS. 7A-B and 8A-C, the lock/release mechanism 20 further includes a plunger 48 which is movably mounted, substantially along the medial axis X between the two arms 22. This plunger 48 has a central body 50 and two lateral wings 52 extending opposite to one another toward the two arms 22. The central body 50 extends longitudinally parallel to the medial axis X, between a first, substantially flat free end 50A which bears against the cam surface 42 of the shaving cartridge 14 (see FIG. 8A), and a second end 50B facing away from the shaving cartridge 14.

A recess 54 may be hollowed out in the central body 50, the recess 54 forming a blind hole which opens at the second end 50B of the central body 50, in the direction of the handle 12. Each lateral wing 52 may include a detent 56 protruding parallel to the medial axis X toward the shaving cartridge 14, the detent 56 facing an inwardly extending protrusion 58 belonging to the corresponding arm 22. The protrusion 58 has an opening 60 which is limited inwardly by a rim 62 belonging to the protrusion 58. Besides, the lateral wings 52 of the plunger 48 may each have respectively two ribs 64 which extend in a medial plane of the arms 22, opposite to the central body 50.

The plunger 48 is elastically biased toward the cam surface 42 of the shaving cartridge 14 so as to cooperate therewith by camming action to bias the shaving cartridge 14 in rotation about pivot axis A toward a rest position. In the example shown in the figures, the plunger 48 is elastically biased by a helicoïdal spring 66, which has a first spring end fitted into the recess 54 and a second spring end fitted into a recess 68, for instance in the form of a blind hole, hollowed out in an arm pusher 70.

The arm pusher 70 is disposed between the arms 22 in line with the plunger 48 along the medial axis X. More specifically, the arm pusher 70 is disposed between the plunger 48 and the hinge 23 along the medial axis X. The recess 68 opens parallel to the medial axis X toward the plunger 48.

The arm pusher 70 is slidably mounted between the arms 22, substantially parallel to the medial axis X and is elastically biased by the spring 66 toward the handle 12, i.e. away from the shaving cartridge 14. The arm pusher 70 cooperates by camming action with the two arms 22, more specifically with the two pushbuttons 24 for biasing the arms 22 outwardly away from each other, toward a head locking position shown in FIG. 8B, where lateral edges 26B of the shell bearings 26 penetrate in the corresponding arcuate slots 28 of the shaving cartridge 14.

The arm pusher 70 has preferably a central body 72 in which the recess 68 is hollowed out, and two lateral extensions 74 extending opposite to one another toward the two arms 22 and cooperating by camming action respectively with the two arms 22 for biasing the arms toward the head locking position. More particularly, these lateral extensions 74 may penetrate in two slots 76 formed respectively in the two arms and facing each other. The two lateral extensions 74 of the arm pusher 70 may have lateral edges 78 which cooperate by camming action with the respective bottoms 80 of the slots. The lateral edges 78 may be diverging from the medial axis X in a direction away from the handle 12, whereas the bottoms 80 may also diverge from the medial axis in the direction away from the handle 12.

Thanks to these dispositions, the same spring 66 is used to bias the plunger 48 elastically toward the cam surface 42 of the shaving cartridge 14 and to bias the arm pusher 70 away from the shaving cartridge 14, thus biasing both the shaving cartridge 14 in rotation toward the rest position and the arms 22 toward the shaving cartridge lock position. It should be noted that the plunger 48 is maintained between the two arms 22 both by cooperation with the spring 66 by abutment against the cam surface 42 of the shaving cartridge 14 and eventually by abutment against the protrusions 58 of the arms 22.

When a shaving cartridge 14 is mounted on the razor handle 12, the lock/release mechanism 20 is normally in the head lock position (see FIG. 8B). Starting from this position, when a user wishes to exchange shaving cartridges, he first pushes on both pushbuttons 24, which brings the arm 22 toward each other against the camming action of the arm pusher 70. During this movement, the arm pusher 70 slides along the medial axis X toward the plunger 48. When the arms 22 have sufficiently moved toward each other to reach the head release position shown in FIG. 8A, the shaving cartridge 14 is released by the shell bearings 26 and is simultaneously ejected by the plunger 48.

The plunger 48 then moves forward to an outwardly protruding position, so that the detents 56 of the plunger penetrate in the openings 60 of the protrusions 58 of the arms. In this position, as shown in FIG. 8A, the arms 22 are maintained in the head release position by abutment of the rims 62 against the detents 56, thus cooperating by hooking action.

Afterwards, when a new shaving cartridge 14 is fixed to the handle 12, the shell bearings 26 are inserted between the arcuate slots 28 of the new shaving cartridge 14 and the cam surface 42 of the new shaving cartridge pushes the plunger 48 backward toward the handle. The arms 22 are then released and moved away from each other under the action of the arm pusher 70, so that the shell bearings 26 insert themselves in the arcuate slots 28 of the new shaving cartridge, and the lock/release mechanism 20 is again in the position shown in FIG. 8B (head locked position).

When a user pushes on both pushbuttons 24, the handle is in the head release position like depicted on FIG. 8A and can receive the ribs 30 of a shaving cartridge 14 to be locked.

When the shell bearings 26 are inserted between the arcuate slots 28 and the user releases the pushbuttons 24, the cam surface 42 of the new shaving cartridge pushes the plunger 48 backward toward the handle and the lock/release mechanism 20 is again in the position shown in FIG. 8B (head lock position) and the new shaving cartridge 14 is fixed to the handle 12.

In the position illustrated on FIG. 8B, the shaving cartridge 14 is pivotally connected on the handle 12, the front faces 26A of the shell bearings 26 bearing respectively on the second arcuate convex surfaces 34, whereas the lateral edge 26B of the shell bearings 26 is in contact with the internal face 29' of the ribs 30.

Figure 5:
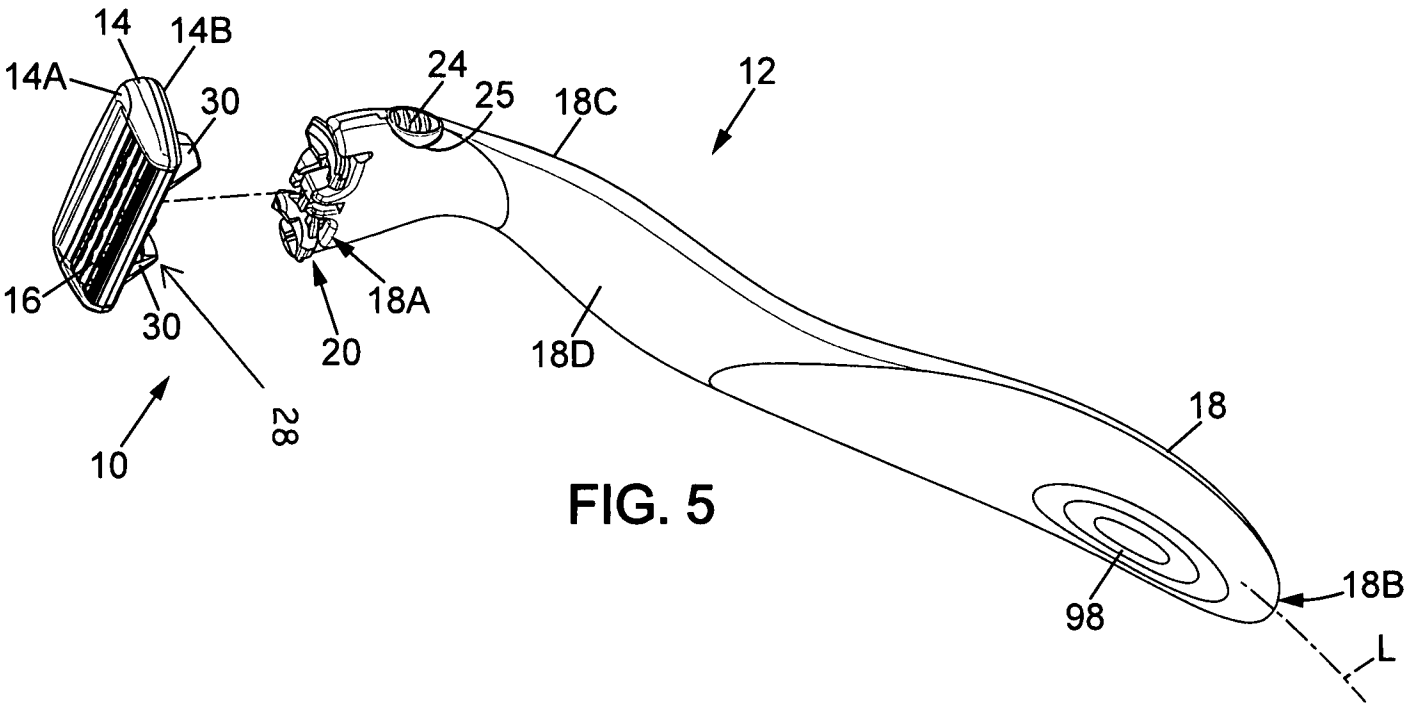
FIG. 5 is a perspective view of the razor shown in FIG. 1A, the shaving cartridge being released.

In order to improve the gripping of the razor handle 12 and thus the shaving, the handle body 18 can be provided with a first finger rest area 96 on the upper face 18C of the handle body 18 (see FIG. 6B), and with a second finger rest area 98 on the lower face 18D of the body (see FIG. 5 or 6A), the finger rest areas 96 and 98 may be flexible gripping areas made of an injected moulded elastomeric material, whereas the rest of the handle can be substantially rigid backbone of an injected moulded thermoplastic, non elastomeric material.

With such a razor 10, a user is able to shave selectively either with the shaving blades 16, when the protective cover 15 is released from the shaving cartridge 14 or with the trimming blade 156 when the protective cover 15 is covering the shaving cartridge 14.

Hence, in a first shaving manner in which the protective cover 15 is removed from the shaving cartridge 14, the user can shave "traditionally" with the shaving cartridge 14. When the protective cover 15 is already covering the shaving cartridge 14, the user has just to slide the protective cover 15 from the shaving cartridge 14 and shave.

In a second manner in which the protective cover 15 is covering the shaving cartridge 14, the user can shave body hair to a given length with the trimming blade 156 and the comb 154. In that last case, the user has just to slide the protective cover 15 onto the shaving cartridge 14 if it is not yet provided onto it.

The invention claimed is:

1. A protective cover for a shaving cartridge including a housing for securely retaining shaving blades, each shaving blade having a cutting edge, the protective cover, being structurally separate from the shaving cartridge, comprising a housing extending longitudinally along a longitudinal axis, and including a comb at least one trimming blade, and an opening configured to slidably receive the shaving cartridge such that the housing of the protective cover, when slid onto the shaving cartridge, completely and directly covers the cutting edges of the shaving blades, the at least one trimming blade having an elongated straight cutting edge and the comb having several teeth projecting perpendicularly to the longitudinal axis and protruding forwardly with regard to the at least one trimming blade.

2. A protective cover for a shaving cartridge including a housing for securely retaining shaving blades, each shaving blade having a cutting edge; the protective cover, being structurally separate from the shaving cartridge, comprising a housing extending longitudinally along a longitudinal axis, and including a comb, at least one trimming blade, and an opening configured to slidably receive the shaving cartridge such that the housing of the protective cover, when slid onto the shaving cartridge, completely and directly covers the cutting edges of the shaving blades, the at least one trimming blade having an elongated straight cutting edge parallel to the longitudinal axis and the comb having several teeth projecting perpendicularly to the longitudinal axis and protruding forwardly with regard to the at least one trimming blade.

3. The protective cover according to claim 2, wherein the teeth protrude forwardly with regard to the housing of the protective cover.

4. The protective cover according to claim 2, wherein the protective cover is provided with a rear opening in connection with the opening through which, when the shaving cartridge having connecting members is covered by the protective cover, the connecting members are accessible for connection to a razor handle.

5. The protective cover according to claim 2, wherein the housing of the protective cover comprises a front face and a rear face, the at least one trimming blade and the comb being provided on the front face.

6. The protective cover according to claim 5, wherein a rear opening in connection with the opening is provided on the rear face.

7. The protective cover according to claim 5, wherein the housing of the protective cover comprises an upper part and a lower part, the comb being provided on the upper part and the at least one trimming blade being located between the upper part and the lower part.

8. The protective cover according to claim 7, wherein a cavity is provided between the upper part and the lower part.

9. The protective cover according to claim 8, further comprising a rearwardly skin contacting surface located rearward of the at least one trimming blade, the elongated straight cutting edge of the at least one trimming blade being inclined with regard to a plane tangential to the rearwardly skin contacting surface.

10. The protective cover according to claim 9, wherein the at least one trimming blade is fixedly and unreleasably mounted in the housing of the protective cover.

11. The protective cover according to claim 10, wherein the at least one trimming blade is rivet mounted in the housing of the protective cover.

12. The protective cover according to claim 2, wherein the housing of the protective cover comprises a back ventilation opening.

13. The protective cover according to claim 12, further provided with several combs.

* * * * *